US007802779B2

(12) United States Patent
Kamiya

(10) Patent No.: US 7,802,779 B2
(45) Date of Patent: Sep. 28, 2010

(54) SHEET PROCESSING APPARATUS AND IMAGE FORMING DEVICE HAVING THE SAME

(75) Inventor: Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 255 days.

(21) Appl. No.: 12/019,951

(22) Filed: Jan. 25, 2008

(65) Prior Publication Data

US 2008/0214377 A1 Sep. 4, 2008

(30) Foreign Application Priority Data

Feb. 2, 2007 (JP) ..... 2007-024371
Jan. 17, 2008 (JP) ..... 2008-008379

(51) Int. Cl.
*B31F 1/10* (2006.01)

(52) U.S. Cl. ..... 270/45; 270/32; 270/58.07

(58) Field of Classification Search ..... 270/32, 270/37, 45, 58.07; 493/406, 415, 416, 421, 493/435, 445
See application file for complete search history.

(56) References Cited

U.S. PATENT DOCUMENTS

| | | | | |
|---|---|---|---|---|
| 3,083,010 | A | 3/1963 | Salmon et al. | |
| 3,570,841 | A | 3/1971 | Rettig | |
| 3,698,705 | A | 10/1972 | Funk et al. | |
| 5,876,320 | A | 3/1999 | LeCompte | |
| 6,024,682 | A | 2/2000 | Mandel | |
| 6,647,243 | B2 | 11/2003 | Sato et al. | 399/407 |
| 6,671,491 | B1 | 12/2003 | Yamanaka et al. | 399/407 |
| 6,709,375 | B2 | 3/2004 | Groenenberg et al. | |
| 6,845,228 | B2 | 1/2005 | Suzuki et al. | 399/407 |
| 6,905,118 | B2 * | 6/2005 | Yamada et al. | 270/8 |
| 7,050,752 | B2 | 5/2006 | Sato et al. | 399/405 |
| 7,107,006 | B1 | 9/2006 | Sato et al. | 399/407 |
| 7,120,383 | B2 | 10/2006 | Sato et al. | 399/407 |
| 7,147,598 | B2 * | 12/2006 | Fujimoto et al. | 493/405 |
| 7,431,274 | B2 * | 10/2008 | Kushida et al. | 270/37 |
| 2002/0086786 | A1 | 7/2002 | Kamizuru et al. | |
| 2004/0089999 | A1 | 5/2004 | Trovinger et al. | |

(Continued)

FOREIGN PATENT DOCUMENTS

| | | |
|---|---|---|
| JP | 2003-182928 | 7/2003 |

(Continued)

OTHER PUBLICATIONS

Official Letter/Search Report, issued by the European Patent Office, on Aug. 8, 2008, in European Application No. 08150986.1.

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

A sheet processing apparatus staples a bundle of sheets, folds the sheets into two to make a book, and presses the folded sheets.

A stitch bookbinding unit moves a press unit having press rollers and, a press holder, and the like constituting a creasing unit along the fold of a bundle of sheets subjected to the folding process by the press rollers and so as to reliably nip-press the fold by the nip between the moving press rollers and for pressing it. The press holder performs intermittent movement in which it is stopped during movement.

11 Claims, 36 Drawing Sheets

U.S. PATENT DOCUMENTS

2005/0127596 A9 6/2005 Trovinger et al.
2005/0189689 A1* 9/2005 Kushida et al. ..... 270/37
2006/0263174 A1* 11/2006 Oikawa et al. ..... 412/33
2006/0281620 A1* 12/2006 Hayashi et al. ..... 493/405
2007/0045919 A1* 3/2007 Hayashi ..... 270/32
2007/0060459 A1* 3/2007 Hayashi ..... 493/434
2007/0120309 A1* 5/2007 Itagaki ..... 270/41
2008/0315484 A1* 12/2008 Iguchi et al. ..... 270/20.1
2009/0057977 A1* 3/2009 Kawaguchi ..... 270/37

FOREIGN PATENT DOCUMENTS

JP 2005-212991 8/2005

* cited by examiner

SHEET PROCESSING APPARATUS AND IMAGE FORMING DEVICE HAVING THE SAME

BACKGROUND OF THE INVENTION

1. Field of the Invention

The present invention relates to a sheet processing apparatus which is equipped in an image forming device such as a copying machine, a facsimile machine, a printer, and a multiple function processing machine and subjects a bundle of sheets such as recoding sheets for recording image information of an original to the binding process by a staple, and the like.

2. Description of the Related Art

In a sheet processing apparatus which processes a sheet formed with an image, stitch bookbinding which binds a bundle of conveyed and stacked sheets, e.g., near its center portion, in its conveying direction and folds the bound portion into two like a book for discharge. In this case, the center portion of the bundle of sheets subjected to the binding process is pushed into the nip between a pair of folding rollers by a push-out member, and the bundle of sheets is then folded by the pair of folding rollers. A sheet post-processing apparatus which presses the fold of the folded portion has been proposed (for example, see Japanese Patent Application Laid-Open No. 2003-182928).

The sheet post-processing apparatus will be schematically described with reference to FIGS. 32 and 33. A plurality of sheets stacked on a stacking portion 70 are aligned so as to be a bundle of sheets. The bundle of sheets is then stapled in the center portion in its conveying direction. The center portion of the bundle of sheets is pushed into the nip between a pair of first folding rollers 83 and 84 by a push-out plate member 82. The bundle of sheets is folded while being conveyed and is then stopped once. As shown in FIG. 34, the folded portion is nipped using a second folding roller 85 different from the first folding rollers 83 and 84. The second folding roller 85 is rotatably supported by a support shaft 851 as a bearing member. The support shaft 851 is moved along the fold in the sheet width direction orthogonally intersecting the conveying direction. Thereby, the fold is pressed by the second folding roller 85. Such creasing is performed to obtain a bundle of folded sheets P as a book subjected to the folding process. The first folding rollers 83 and 84 then start to rotate again and convey the bundle of folded sheets P to discharge it onto a tray 63.

In the case of the sheet post-processing apparatus shown in FIGS. 32 to 34, since the second folding roller 85 for pressing the fold merely runs therealong, it is hard to determine whether the fold is sufficient so that the fold can be weak. In this regard, an apparatus which presses the fold of a bundle of folded sheets by changing the running speed of the second folding roller 85 has been proposed. However even if the roller running speed is changed, the bundle of sheets instantly passes through the folding portions and there remains the problem that folding cannot be fixed.

Against the problem, there has been proposed another apparatus which reciprocates a creasing roller like the second folding roller 85 along the fold several times. In this case, the creasing roller is reciprocated several times along the fold for each bundle of folded sheets, which has low productivity and is not practical. In addition, the members of the roller reciprocating constitution are required for mechanically significant durability, which drastically increases the cost. A large stress acts also on a sheet having a low friction coefficient (p) or a thin sheet, such as a color sheet, due to roller reciprocation. Thereby, wrinkles and tears are easy to occur in the cover sheet of the bundle of folded sheets P.

There has been proposed yet another apparatus which combines a creasing roller with a punching machine as a unit and stops the operation of the unit and the creasing roller at the same time at punching (for example, see JP-A No. 2005-212991). In this case, however, the creasing roller is stopped for punching and the problem cannot be solved from the object of pressing the fold of a bundle of folded sheets.

Any of the related art sheet processing apparatuses cannot solve the problem that the bundle of folded sheets P whose fold is weak is swelled from the fold, resulting in deterioration of the appearance or look as a book. When the fold properties of the fold are week and low, and a plurality of processed bundles of sheets are stacked, the next bundle of sheets slips into a head bundle of sheets, which is significantly inferior in stacking capacity (see FIG. 31). Due to the slipping of the bundle of sheets, jamming is caused during conveyance in the sheet processing apparatus and the number of bundles of sheets made is likely to be miscounted. Therefore a new problem of affecting operability arises.

Accordingly, an object of the present invention is to provide a sheet processing apparatus, when a bundle of sheets subjected to the binding process is folded into two to make a book, for pressing the fold so as to improve its look.

SUMMARY OF THE INVENTION

To achieve the above object, a representative sheet processing apparatus of the present invention includes a folding unit for performing a folding process to a sheet to the folding process; and a creasing unit for pressing the fold of the sheet folded by the folding unit, wherein the creasing unit and the folded sheet are relatively moved along the fold and are intermittently stopped while being pressed by said creasing unit.

According to the sheet processing apparatus of the present invention, since the creasing unit or the bundle of folded sheets are intermittently stopped during movement to subject the fold of the bundle of folded sheets to the creasing process the quality such as the look of the bundle of sheets bound as a book can be enhanced. Also when the bundle of sheets subjected to the creasing process is stacked on a stack tray, it can be orderly stacked without being collapsed. Therefore it is possible to provide a sheet processing apparatus which has improved stacking properties, prevents the number of bundles of sheets from being miscounted, and is excellent in utility and productivity.

Further features of the present invention will become apparent from the following description of exemplary embodiments with reference to the attached drawings.

DESCRIPTION OF THE EMBODIMENTS

Embodiments of a sheet processing apparatus and an image forming device according to the present invention will be described below in detail with reference to the drawings.

Figure 1:
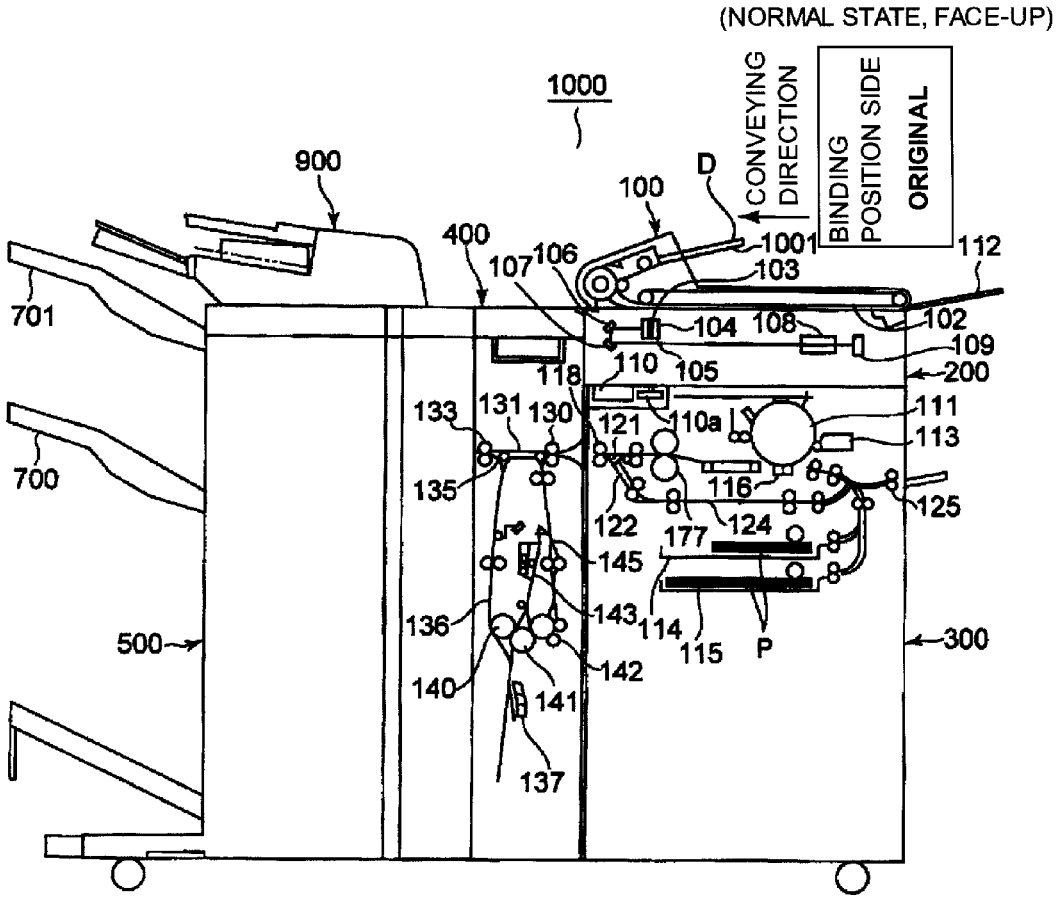
FIG. 1 is a cross-sectional view of a copying machine as an image forming device of an embodiment of the present invention in its sheet conveying direction.

FIG. 1 shows a copying machine 1000 as an example of an image forming device equipped with a sheet processing apparatus of this embodiment. With reference to a block diagram of FIG. 16, the copying machine 1000 comprises an original feeding portion 100, an image reader portion 200, a printer portion 300, a folding process portion 400, a finisher 500, a stitch bookbinding unit 800, an inserter 900, and the like. The folding process portion 400, the stitch bookbinding unit 800, and the inserter 900 can be attached as an option to the image forming device.

Figure 16:
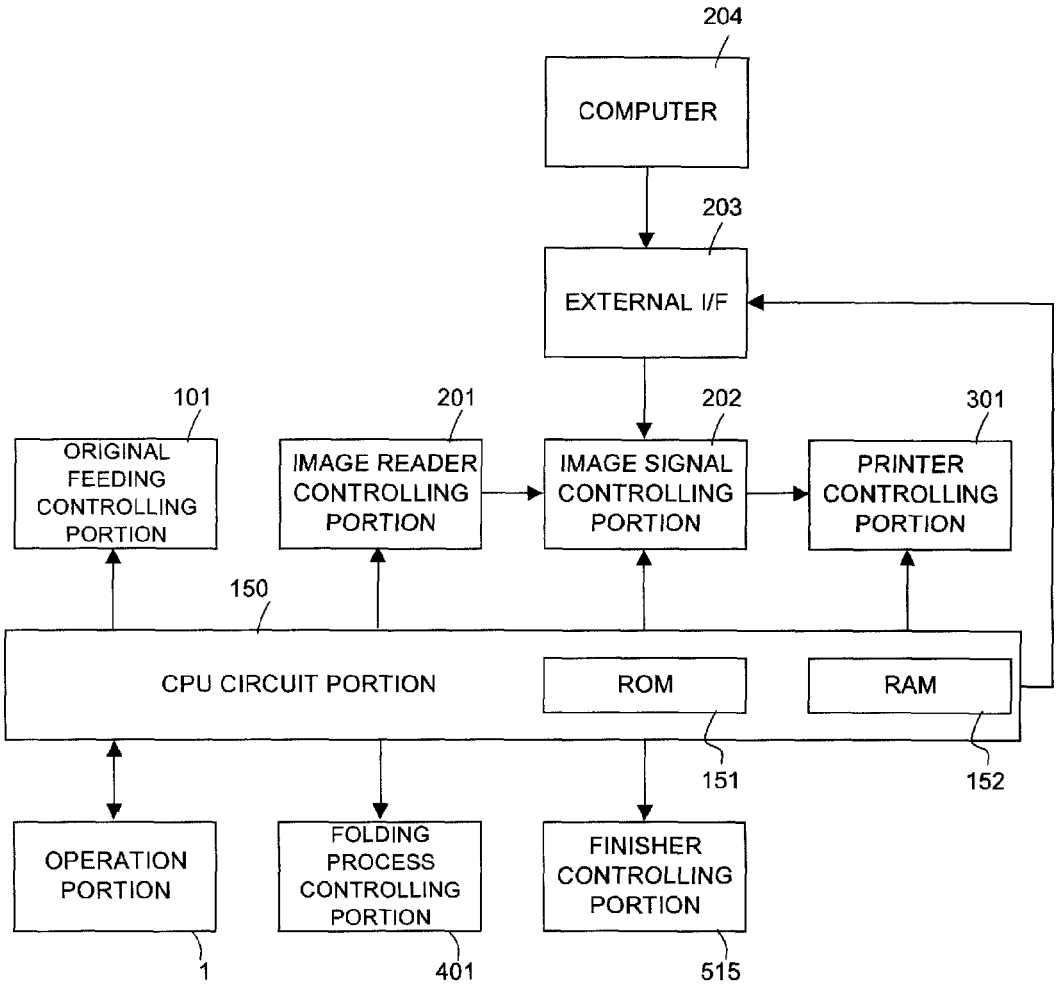
FIG. 16 is a control block diagram of the entire copying machine.

In FIG. 16, a CPU circuit portion 150 is provided in the printer portion 300 as the main body of the image forming device and has the CPU circuit portion 150 (central processing unit, not shown) as the nucleus of controlling unit. The CPU circuit portion 150 controls over the above portions based on a control program stored in a ROM 151 and setting of an operation portion 1. In other words, the CPU circuit portion 150 controls an original feeding controlling portion 101, an image reader controlling portion 201, an image signal controlling portion 202, a printer controlling portion 301, a folding process controlling portion 401, a finisher controlling portion 515, and an external I/F 203. The original feeding controlling portion 101 controls the original feeding portion 100. The image reader controlling portion 201 controls the image reader portion 200. The printer controlling portion 301 controls the printer portion 300. The folding process controlling portion 401 controls the folding process portion 400. The finisher controlling portion 515 is provided in the finisher 500 and controls the finisher 500, the stitch bookbinding unit 800, and the inserter 900. The operation portion 1 is provided in the main body of the image forming device and has a plurality of keys for setting various functions about image formation, a display portion for displaying a set state, and the like. The operation portion 1 outputs a key signal corresponding to operation of each of the keys by a user to the CPU circuit portion 150 and displays corresponding information based on a signal from the CPU circuit portion 150 on the display portion.

A RAM 152 is used as a region for temporarily holding control data and a working region of computation with control. The external I/F 203 is the interface of the copying machine 1000 and an external computer 204 and develops print data from the computer 204 to a bitmap image to output it as image data to the image signal controlling portion 202. The image of an original read by an image sensor, not shown, is outputted from the image reader controlling portion 201 to the image signal controlling portion 202. The printer controlling portion 301 outputs the image data from the image signal controlling portion 202 to an exposure controlling portion (not shown). The constitution and operation of the above portions are as follows.

Originals are placed and set on a tray 1001 of the original feeding portion 100 in the normal state seen from the user and in the face-up state in which the surfaces of the originals on which image information is recorded face up. The binding positions of the originals are, in this case, at the left edge of each of the original. The originals set on the tray 1001 are fed one by one in the order from the first page, with the original binding position in the left direction indicated by an arrow in the drawing as the head. The original passes through a curved conveying path, moves on a platen glass 102 from left to right, and passes on a scanner unit 104, thereby reading the image information. A reading method of reading the original while it is conveyed and moved can be called "scanning". That is, when the original is moved on the platen glass 102, the scanner unit 104 illuminates the reading surface of the original being moved with a lamp 103. The reflected light from the original is guided to an image sensor 109 by mirrors 105, 106, and 107 arranged in a plurality of locations and a lens 108. The scanned original is discharged onto a discharge tray 112.

In addition to the reading method of scanning the original, "standstill reading" for reading the original which is standstill on the platen glass 102 is also performed. In this case, the original fed from the original feeding portion 100 is stopped once on the platen glass 102 so as to be brought into a standstill. The scanner unit 104 is moved from left to right in the drawing with respect to the standstill original, thereby reading the image information of the original.

When the original is read without using the original feeding portion 100, the user lifts and opens the original feeding portion 100 which is not used this time and then places and sets the original on the platen glass 102 to press it from above. The scanner unit 104 is moved in that state to read the image information of the original. In this case, the original is also read in standstill manner as above.

The image data of the original read by the image sensor 109 by any one of the reading methods is transmitted to an exposure controlling portion 110. The exposure controlling portion 110 outputs laser beams according to an image signal and illuminates a photosensitive drum 111 as an image bearing member constituting the image forming portion together with a later-described development device 113 while the laser beams which are being scanned by a polygon mirror 110*a*. An electrostatic latent image according to the scanned laser beam is formed on the photosensitive drum 111. The electrostatic latent image formed on the photosensitive drum 111 is developed by the development device 113 so as to be visualized as a toner image.

The toner image is transferred by a transfer portion 116 on a sheet such as a recording sheet conveyed from any one of cassettes 114 and 115, a manual feeding portion 125, and a duplex conveying path 124. The sheet on which the toner image is transferred is fed to a fixing portion 177 so as to be heated and pressurized for permanently fixing the toner image. The sheet which has been subjected to the fixing process and passed through the fixing portion 177 is guided once to a conveying path 122 by a flapper 121. Passage of the rear edge of the sheet through the flapper 121 is detected for switchback operation. The sheet is guided and conveyed to a discharge roller 118 by path switching of the flapper 121 and is then discharged from the printer portion 300. The sheet whose surface formed with the toner image by the series of procedures faces down is discharged as a reversely discharged sheet from the printer portion 300.

When the image forming process is performed in the order from the first page by discharging the sheet in face-down state to the outside of the image forming device or the image forming process is performed using the original feeding portion 100, the page order can be corrected. When the image forming process is performed to the image data transmitted from a host device such as a personal computer, the page order can also be corrected.

Although the image forming process of sheet duplex is not described in detail, it is performed in such a manner that the sheet is guided directly from the fixing portion 177 to the discharge roller 118, is switched back immediately after the rear edge of the sheet passes through the flapper 121, and is guided to a duplex conveying path by the flapper 121.

<<Folding Process Portion>>

The constitution of the folding process portion 400 will be described with reference to FIGS. 1 and 2.

The folding process portion 400 has a conveying path 131 for receiving a sheet discharged from the printer portion 300 and guiding and conveying it to the finisher 500 in the next process. A few sets of, e.g., conveying rollers 130 and discharge rollers 133, are arranged on the conveying path 131. A switching flapper 135 is arranged near the discharge rollers 133 and performs switching operation so as to guide the sheet conveyed by the conveying rollers 130 to either a folding path 136 or the finisher 500.

For the sheet folding process, the switching flapper 135 is switched so as to guide the sheet to the folding path 136, thereby guiding the sheet to the folding path 136. The sheet guided to the folding path 136 is conveyed to folding rollers 140 and 141 and is then folded in Z shape thereon. When the sheet folding process is not performed, the switching flapper 135 is switched so as to guide the sheet to the finisher 500 for taking it therein and then conveys the sheet discharged from the printer portion 300 directly into the finisher 500 via the conveying path 131.

The sheet conveyed to the folding path 136 forms a loop by striking its front edge onto a stopper 137. The sheet in the formed loop is folded by the folding rollers 140 and 141. The sheet in a loop formed by striking the folded portion onto an above stopper 143 is further folded by the folding rollers 141 and 142 in Z shape. The sheet folded in Z shape is guided by conveying paths 145 so as to be conveyed to the conveying path 131 and is then discharged to the finisher 500 arranged on the downstream side by the discharge rollers 133.

<<Finisher>>

The constitution and operation of the finisher 500 will be described with reference to FIGS. 1 and 2.

The finisher 500 takes in a plurality of sheets from the printer portion 300 via the folding process portion 400 and performs the process of binding the taken-in sheets as a bundle of sheets while they are aligned. The finisher 500 subjects the rear edge of the bundle of sheets to the binding process by a staple and performs the sort process and the non-sort process.

Figure 2:
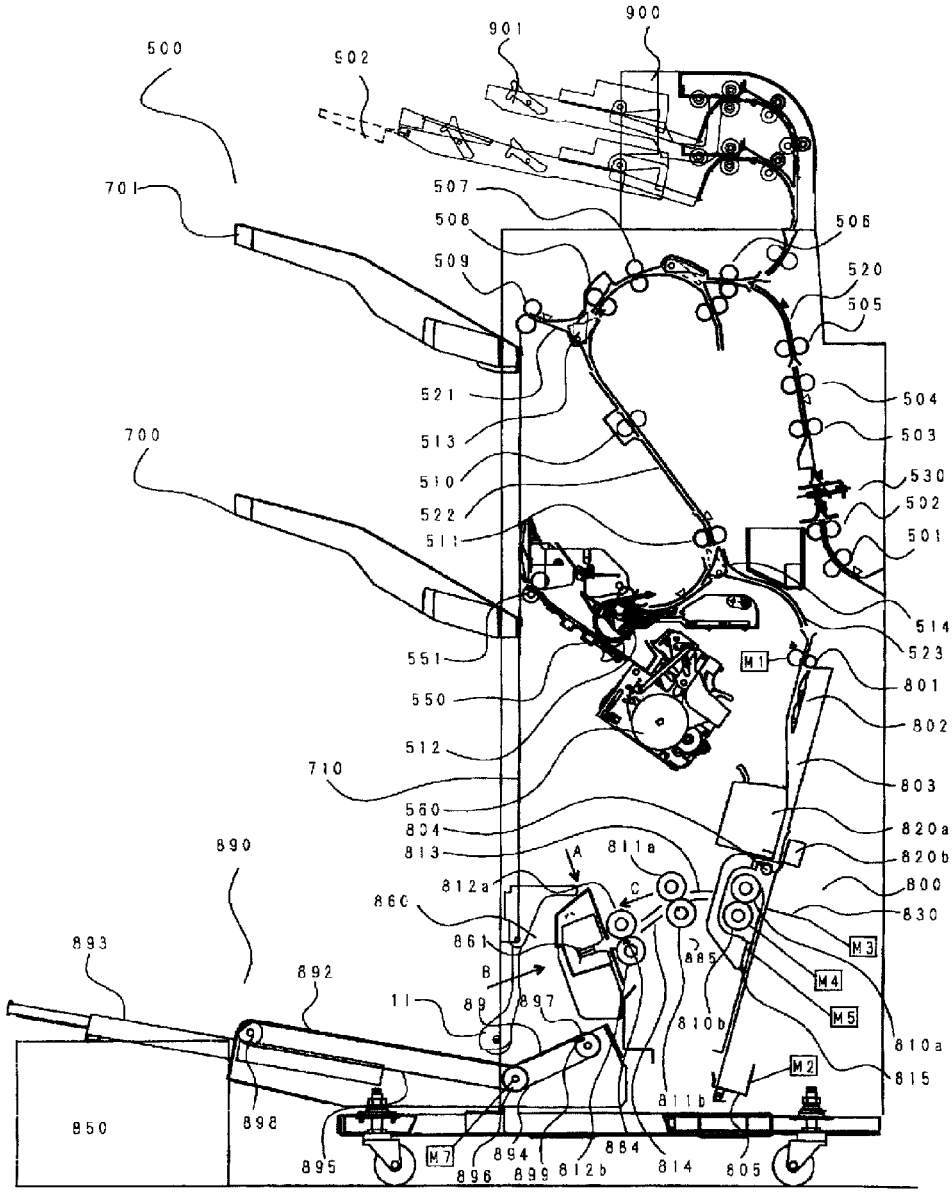
FIG. 2 is a cross-sectional view of a finisher including a stitch bookbinding unit as a sheet processing apparatus of this embodiment in its sheet conveying direction.

As shown in FIG. 2, the finisher 500 has a conveying path 520 for taking the sheet conveyed via the folding process portion 400 therein. The conveying path 520 is provided with a plurality of conveying rollers. A punch unit 530 operated, as needed, to subject the rear edge of the sheet to the punching process is arranged midway on the conveying path 520. Conveying rollers 502 to 508 in pairs are sequentially arranged in order from inlet side rollers 501 toward the downstream side in the sheet conveying direction. The punch unit 530 is provided between the conveying rollers 502 and 503. The punch unit 530 is operated, as needed, to subject the rear edge of the conveyed sheet to the punching process.

A flapper 513 provided at the terminal of the conveying path 520 switches between an upper sheet-discharge path 521 and a lower sheet-discharge path 522 connected to the downstream side. The upper sheet-discharge path 521 guides the sheet to a sample tray 701 by upper sheet-discharging rollers 509. The lower sheet-discharge path 522 is provided with conveying rollers 510, 511, and 512 in pairs. The conveying rollers 510, 511, and 512 convey and discharge the sheet onto a processing tray 550. The sheet discharged onto the processing tray 550 is sequentially subjected to the aligning process so as to be stacked in a bundle. The bundle of sheets is subjected to the sort process and the staple process according to setting from the operation portion 1 by input operation of the user. The processed bundle of sheets is selectively discharged to either a lower stack tray 700 or the upper sample tray 701 by a pair of bundle sheet-discharging rollers 551.

The staple process is performed by a stapler 560 as a stapling device. The stapler 560 is moved in the sheet width direction orthogonally intersecting the sheet conveying direction to bind an arbitrary location of the bundle of sheets. The stack tray 700 and the sample tray 701 can be moved up and down along a device main body 500A of the finisher 500. The upper sample tray 701 receives the sheet from the upper sheet-discharge path 521 and the processing tray 550. The lower stack tray 700 receives the sheet from the processing tray 550. A large amount of sheets are stacked on the stack tray 700 and the sample tray 701. The stacked sheet is aligned by reception of its rear edge by a rear edge guide 710 extended in the vertical direction.

<<Stitch Bookbinding Unit>>

Referring to FIG. 2, the constitution and operation of the stitch bookbinding unit 800 included in the finisher 500 will be described based on FIGS. 3 to 6.

In the following description, the process of folding a bundle of sheets by a pair of folding rollers 810*a* and 810*b* and a push-out member 830 constituting the folding unit shown in FIG. 7 will be called "folding process". The process of creasing the fold of the bundle of sheets subjected to the folding process by a pair of press rollers 861*a* and 861*b* constituting the creasing unit shown in FIG. 3 and thereafter will be called "creasing process". The process including both of the folding process and the creasing process will be merely and generically called "sheet process". As shown in the function block diagram of FIG. 16, the processes are controlled by the CPU circuit portion 150 which is the nucleus of the controlling portions and controls over the operation of the entire system of the image forming device equipped with the sheet processing apparatus of this embodiment. The operations of the following portions and devices are detected by a detecting sensor one by one. A control signal from the CPU circuit portion 150 based on the detection signal is transmitted through the finisher controlling portion 515 to various actuators. The actuators are operated by control of the finisher controlling portion 515 as the controlling unit to drive the portions and devices. In this embodiment, the constitution of the stitch bookbinding unit 800 controlled by the finisher controlling portion 515 provided in the finisher 500 will be described, however, the stitch bookbinding unit 80 may be controlled directly by the CPU circuit portion 150 of the main body of the image forming device.

The portions about the sheet flow to a fold press unit 860 as the essential part of the stitch bookbinding unit 800 will be described. A sheet switched to the right in the drawing by a switching flapper 514 arranged midway on the lower sheet-discharge path 522 passes through a saddle sheet-discharging path 523 and is fed to the stitch bookbinding unit 800. The sheet is delivered to a pair of saddle inlet side rollers 801. Its convey-in inlet is selected by a flapper 802 operated by a solenoid according to size, and the sheet is conveyed into a storing guide 803 of the stitch bookbinding unit 800. The sheet conveyed thereinto is still transferred by a sliding roller 804 till the front edge of the sheet strikes onto a sheet positioning stopper 805 so as to be regulated and aligned. The saddle inlet side rollers 801 and sliding roller 804 are rotated by obtaining rotary power from a motor M1. A stapler 820 is provided so as to interpose therein the storing guide 803 in the opposite position midway in the storing guide 803. The stapler 820 has a driver 820*a* for projecting a staple and an anvil 820*b* for folding the projected staple and binds the bundle of sheets by a staple in their cooperation.

When the center portion of the conveyed-in sheet in the sheet conveying direction is bound by the stapler 820, the sheet positioning stopper 805 is movable so as to be moved and adjusted to the position corresponding to it. Power of the movement and adjustment is received from a motor M2.

Figure 7:
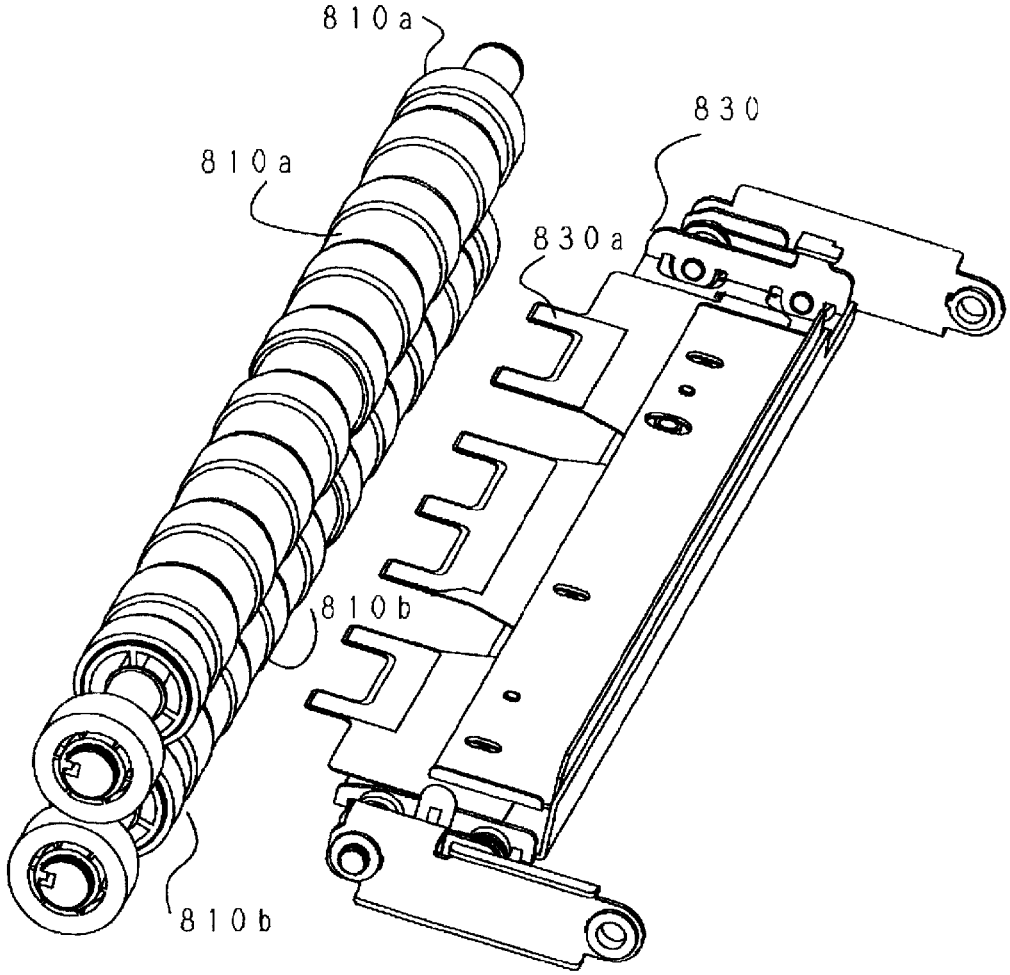
FIG. 7 is an appearance perspective view of a folding unit portion.

The pair of folding rollers 810*a* and 810*b* opposite each other shown in FIG. 7 is arranged on the downstream side of the stapler 820. The push-out member 830 for constituting the folding unit together with the folding rollers 810*a* and 810*b* is provided in the position opposite them. In the push-out member 830, the position saved from the storing guide 803 is a home position. The push-out member 830 is projected toward the stored bundle of sheets upon reception of rotary power from a motor M3 to push the bundle of sheets into the nip between the folding rollers 810*a* and 810*b* for folding the bundle. The push-out member 830 is then retreated to the home position. The folding rollers 810*a* and 810*b* are a pair of rollers having an 810*a* concave portion and an 810*b* concave portion in which the outer circumferential shape of the shaft shape in the longitudinal direction has one or more concave shapes. The edge of the push-out member 830 has an unevenness pitch shape having one or more convex portions 830*a* which can enter or leave the corresponding positions (in the front and back direction) of the 810*a* concave portion and the 810*b* concave portion.

When a sheet having a low friction coefficient like a sheet on which a color image is printed (image formation) is used as a cover sheet, only the cover sheet can be taken out together with the folding roller ahead of the bundle of sheets so as to be separated therefrom. The unevenness shape of the push-out member 830 prevents this. In other words, the push-out member 830 has the unevenness shape for inserting it into the nip between the folding rollers 810*a* and 810*b* so as to entirely and reliably nip the folded portion of the bundle of sheets. Thereby, the push-out member 830 can easily enter and leave the nip between the folding rollers 810*a* and 810*b*. Further, the unevenness shape can maintain a desired image appearance quality so as not to rub the push-out member 830 against the inside sheet at entering and leaving the nip between the folding rollers 810*a* and 810*b*.

With the position saved from the storing guide 803 as the home position, the push-out member 830 pushes out the stored bundle of sheets by obtaining power from the motor M3 and pushes the bundle of sheets into the nip between the folding rollers 810*a* and 810*b*. The push-out member 830 then returns to the home position and makes a comeback. A pressing force F1 necessary and sufficient to fold the bundle of sheets is biased between the folding rollers 810 by a spring (not shown).

The bundle of sheets folded by the folding rollers 810 is discharged onto a folded bundle tray 890 by a pair of first fold conveying rollers 811*a* and 811*b* opposite each other and a pair of second fold conveying rollers 812*a* and 812*b* opposite each other shown in FIGS. 3 to 6. Necessary and sufficient pressing forces F2 and F3 are applied between the first fold conveying rollers 811 and the second fold conveying rollers 812, thereby the bundle of folded sheets can be conveyed and stopped.

A conveying guide 813 guides the bundle of sheets between the folding rollers 810 and the first fold conveying rollers 811. A conveying guide 814 guides the bundle of sheets between the first fold conveying rollers 811 and the second fold conveying rollers 812. The folding rollers 810, the first fold conveying rollers 811, and the second fold conveying rollers 812 nip both sides of the bundle of sheets subjected to the folding process and obtain power from the same motor M4 (not shown) to perform uniform speed rotation.

When the bundle of sheets bound by the stapler 820 is folded, the sheet positioning stopper 805 is lowered for movement and adjustment so that the bundle of sheets is lowered from the staple process execution position by a necessary distance to match the folding position of the bundle of sheets with the nip between the folding rollers 810*a* and 810*b*. The stapled portion of the bundle of sheets is then folded.

Figure 3:
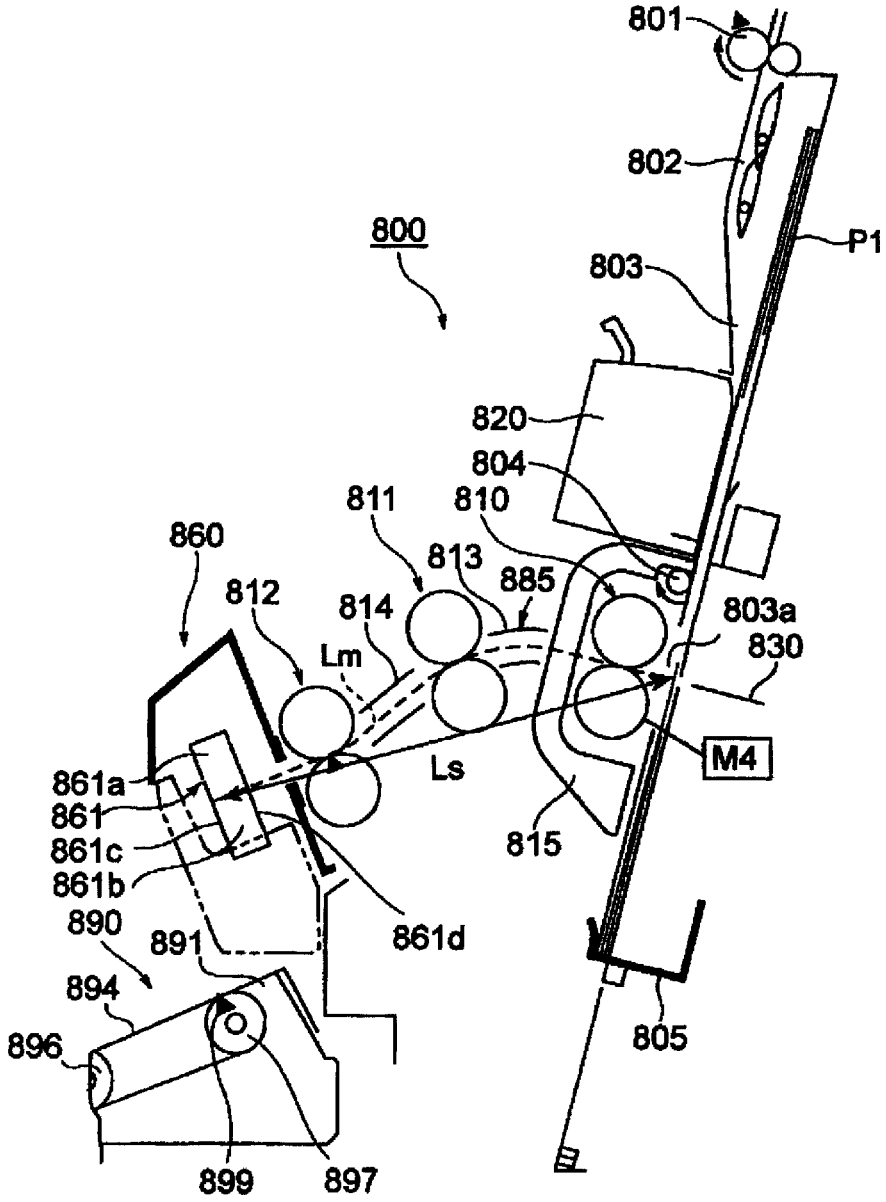
FIG. 3 is a diagram showing the state that a bundle of sheets is stored in a storing guide of the stitch bookbinding unit and is bound.

A pair of aligning plates 815 opposite each other shown in FIG. 3 and thereafter are provided on both sides in the sheet width direction. The aligning plate 815 moves around the outer circumferential surfaces of the folding rollers 810*a* and 810*b*, has a surface projected to the storing guide 803, and regulates and aligns the width direction of the sheets stored in the storing guide 803. The aligning plate 815 obtains power from a motor M5 so as to be moved in the direction nipping the sheet and performs positioning (alignment) in the sheet width direction.

<<Fold Press Unit>>

Referring to FIGS. 2 to 7, the constitution and operation of the fold press unit 860 as the essential part of this embodiment will be described based on FIGS. 8 to 11.

Figure 8:
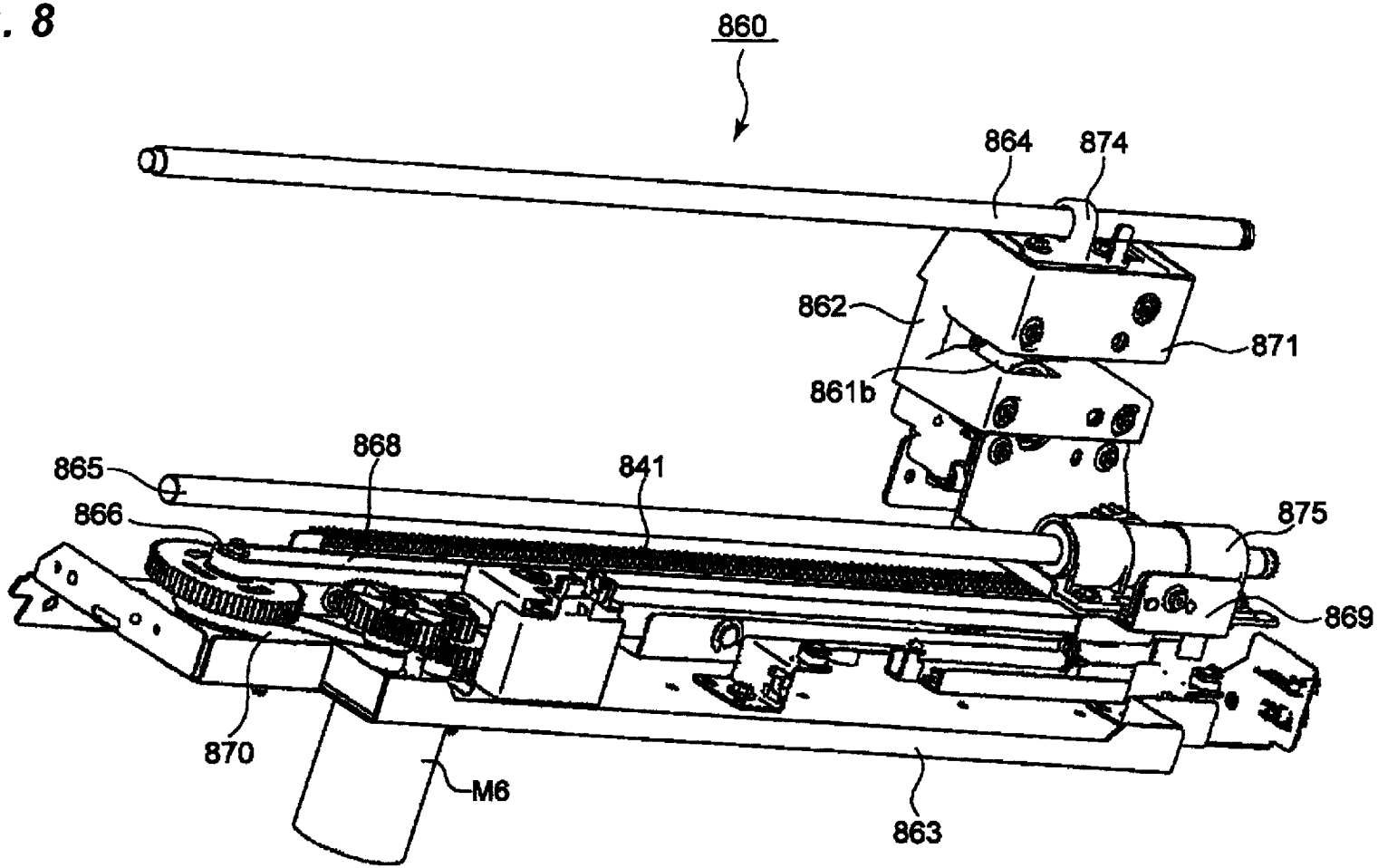
FIG. 8 is a schematic perspective view of the stitch bookbinding unit as the sheet processing apparatus of an embodiment of the present invention.

As shown in FIG. 8, the fold press unit 860 as the "creasing unit" arranged on the downstream side of the second fold conveying rollers 812 has the pair of press rollers 861*a* and 861*b* opposite each other. The fold press unit 860 also has a press holder 862 which constitutes the main part of the creasing unit and rotatably and axially holds the press rollers 861*a* and 861*b*. The press roller 861 nips the folded portion of a bundle of folded sheets and moves the press holder 862 along the fold of the folded portion in that state to make the fold be stronger. A first conveyer belt 894 (see FIG. 3) is arranged just below the fold press unit 860.

The fold press unit 860 has a base sheet metal 863 and two slide shafts 864 and 865 which incorporate the main part and is fixed to the longitudinal side plate of the device main body 500A of the finisher 500 shown in FIG. 2. The two slide shafts 864 and 865 are extended in the longitudinal direction of the finisher 500 in parallel and support the press holder 862 via slide bearings 874 and 875 fixed to the press holder 862.

Figure 10:
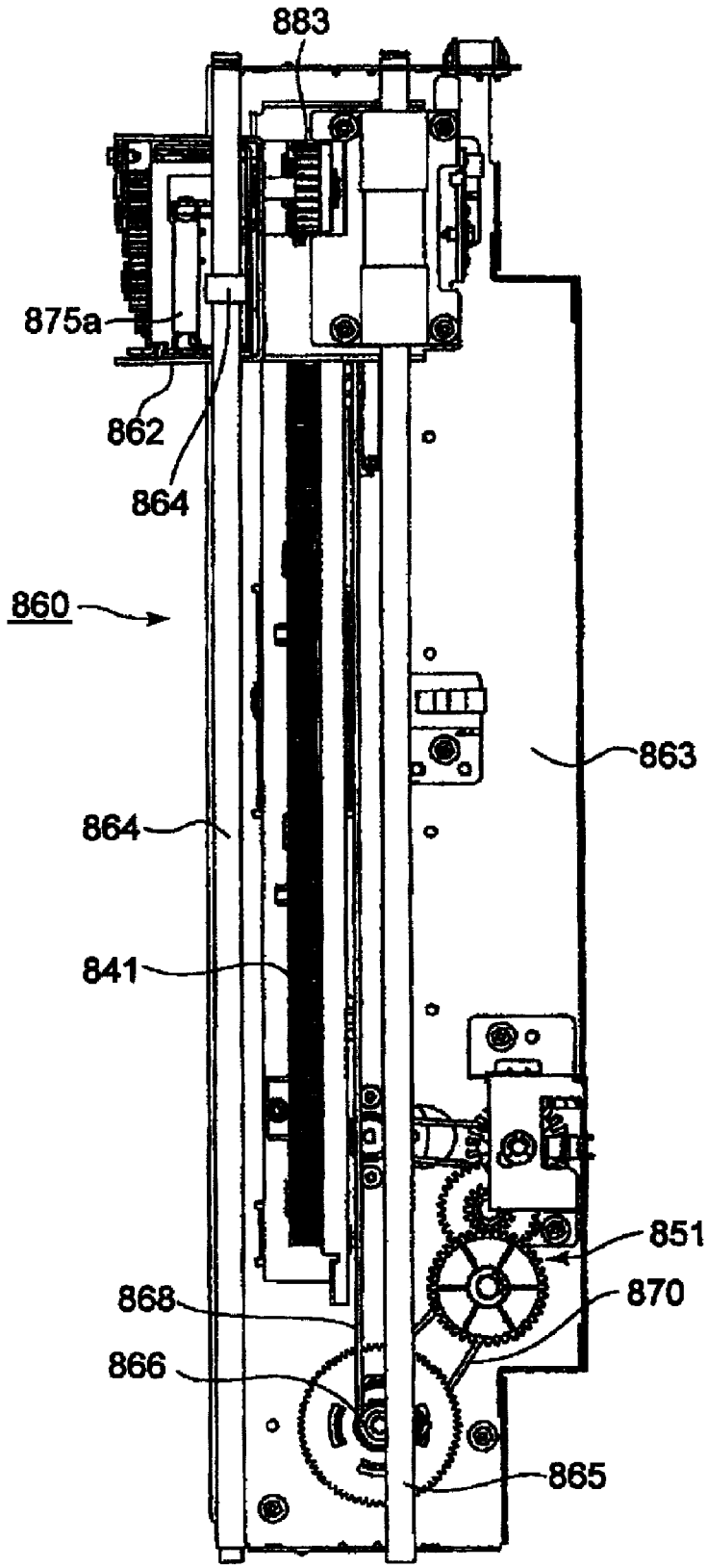
FIG. 10 is a view seen in the direction of an A arrow of FIG. 2 of the fold press unit of the stitch bookbinding unit in FIG. 8.
Figure 11:
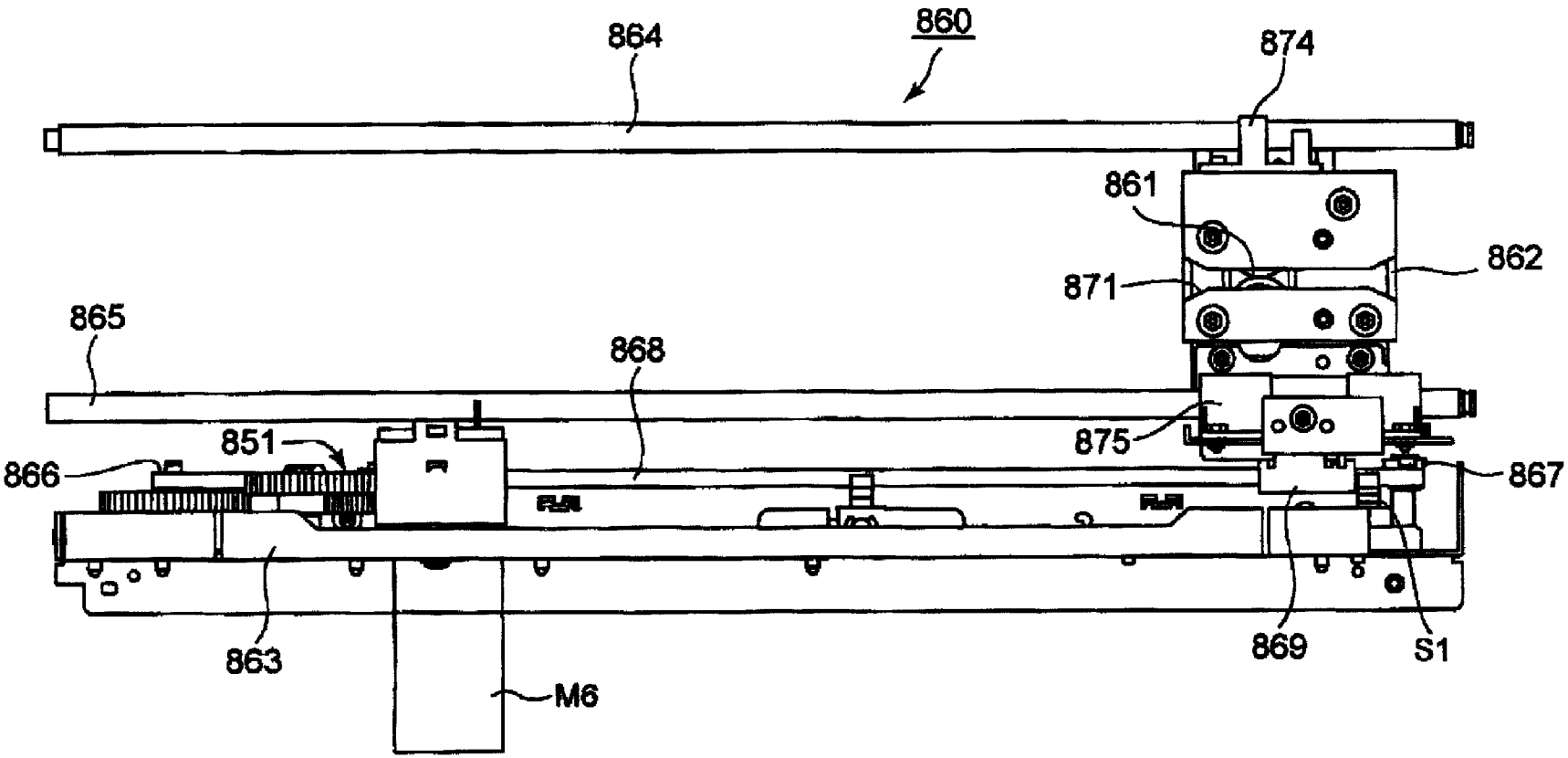
FIG. 11 is a view seen in the direction of a C arrow of FIG. 2 of the fold press unit of the stitch bookbinding unit in FIG. 8.

As shown in FIG. 11, a timing belt 868 is extended across pulleys 866 and 867 rotatably arranged forwardly and rearwardly of the base sheet metal 863. Part of the timing belt 868 is fixed to the press holder 862 by a coupling sheet metal 869. A belt 870 shown in FIG. 10 is engaged onto the pulley 866 and is coupled to a motor M6 attached to the base sheet metal 863 via a gear train 851 for drive transmission. The press holder 862 obtains rotation output of the motor M6 so as to be movable in the sheet width direction as the longitudinal direction of the finisher 500, that is, in the front and back direction. As setting the side in which the user faces the operation portion 1 provided on the main body of the image forming device is the front of the device, the device front side is referred to as "front side", and the device back side is referred to as "back side".

The home position of the press holder 862 is on the back side of the finisher 500 and is detected by an original position detecting sensor S1. When the press holder 862 is located in the home position, the bundle of sheets can be discharged onto the folded bundle tray 890 by the second fold conveying rollers 812.

<<Press Holder>>

Figure 12:
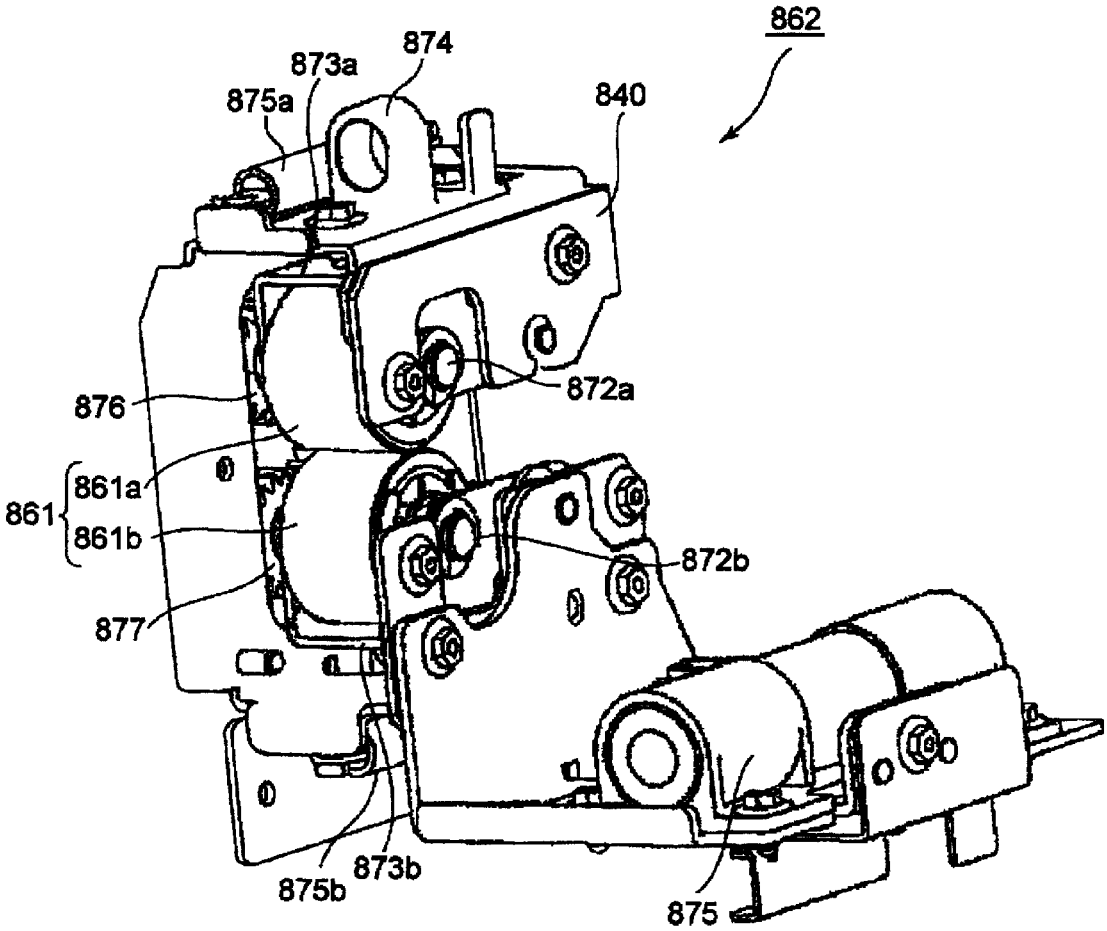
FIG. 12 is an appearance perspective view of a press holder portion of the fold press unit.
Figure 15:
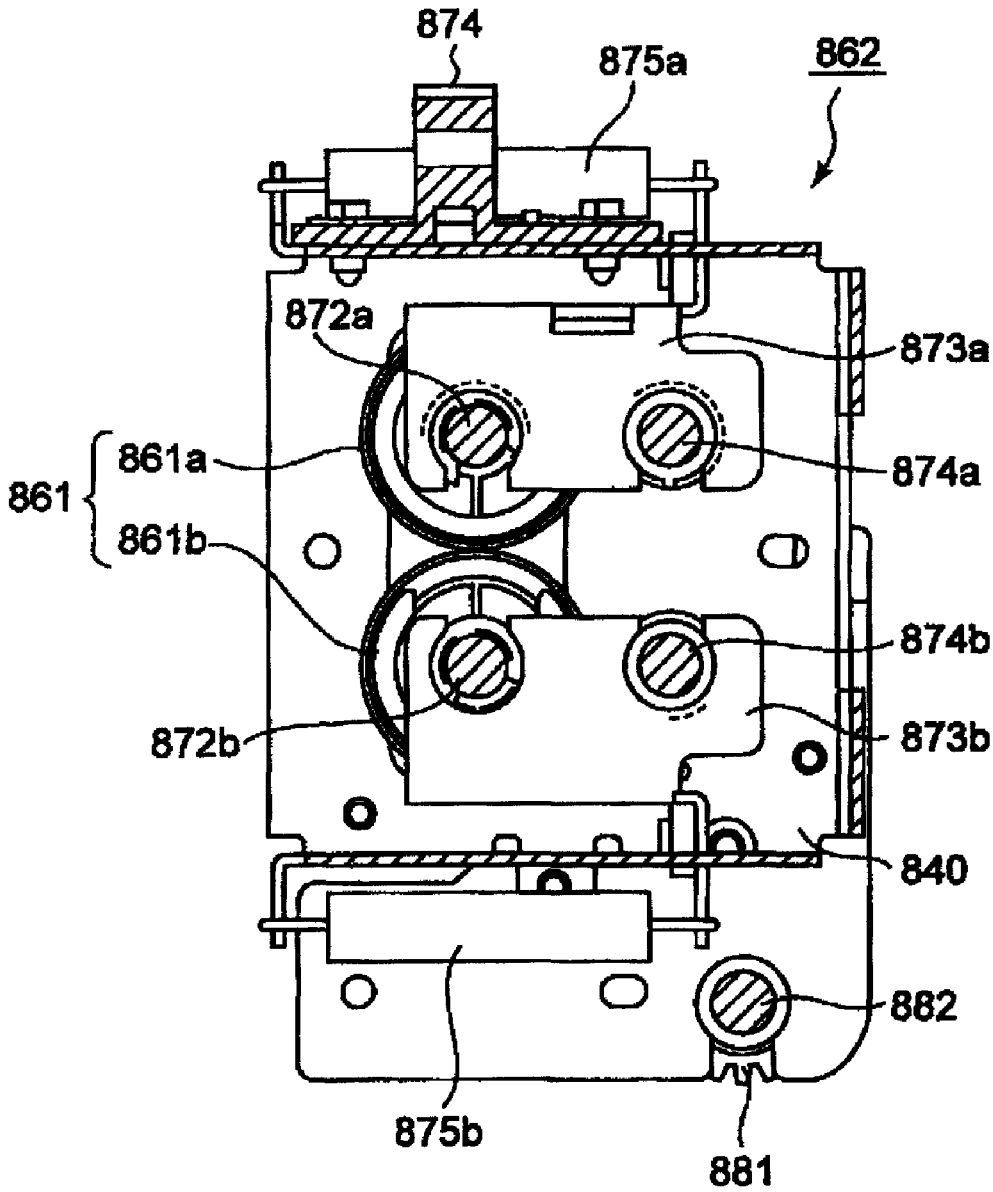
FIG. 15 is a view seen in the direction of an X-X arrow of FIG. 13.

FIG. 12 shows the appearance of the press holder 862. The press holder 862 has a frame 840 to which slide bearings 874 and 875 are screwed. The press rollers 861*a* and 861*b* are fixed to roller shafts 872*a* and 872*b*, respectively, and are rotatably supported by press arms 873*a* and 873*b* via bearings (not shown). The press arms 873*a* and 873*b* shown in FIG. 15 are supported by bearings on swinging shafts 874*a* and 874*b* fixed to the frame 840.

Figure 13:
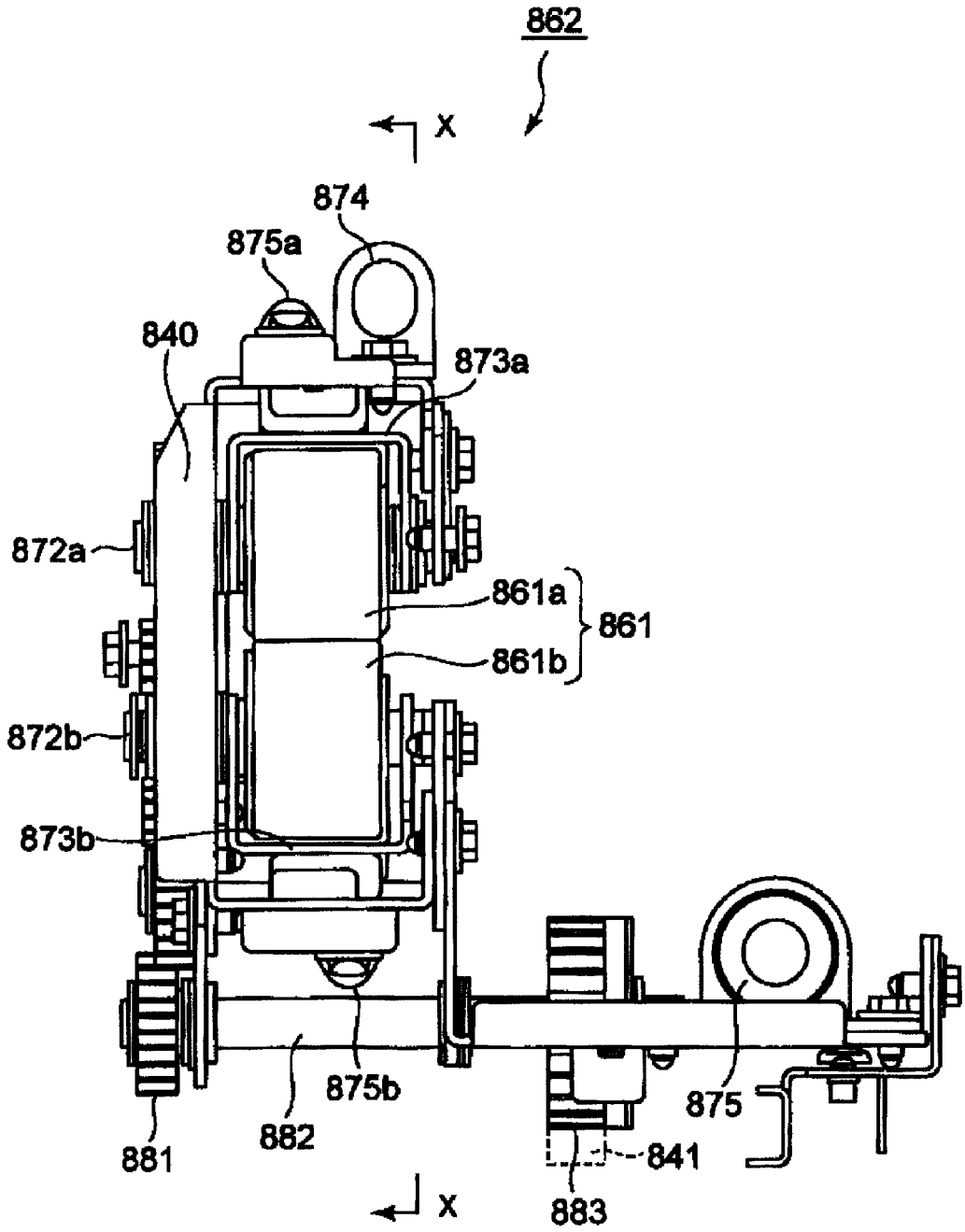
FIG. 13 is a front view of the press holder portion of the fold press unit.
Figure 14:
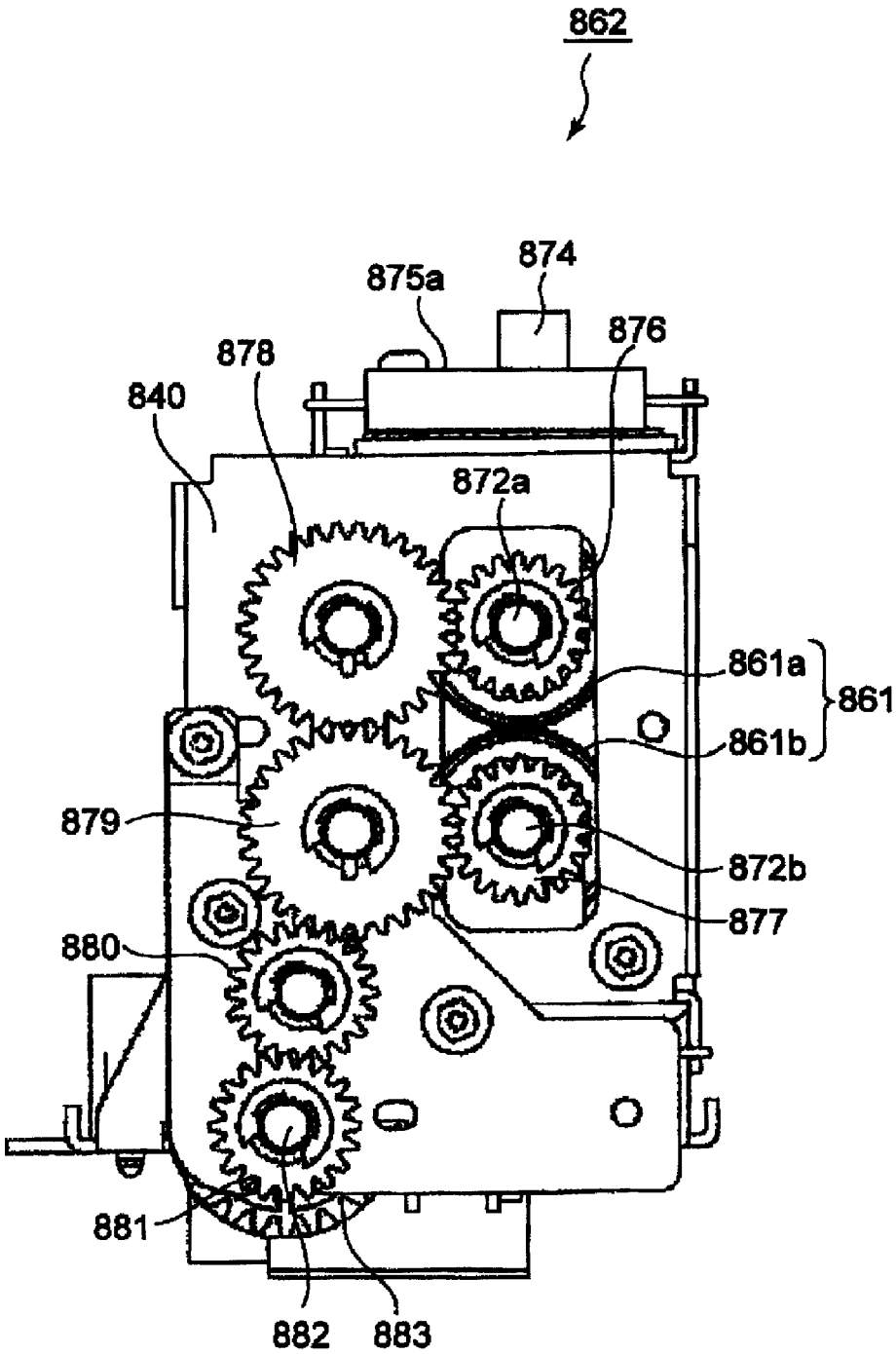
FIG. 14 is a view seen in the direction of a B arrow of FIG. 2 of the fold press unit of the stitch bookbinding unit in FIG. 8.

Tension springs 875*a* and 875*b* are engaged between the frame 840 and ends of the press arms 873*a* and 873*b*. The press rollers 861*a* and 861*b* biased in the direction close to each other by a resilient force of the tension springs 875*a* and 875*b* form the nip between the rollers. When a bundle of folded sheets is fed into the nip between the press rollers 861*a* and 861*b*, the press arms 873*a* and 873*b* are rotated, with the swinging shafts 874*a* and 874*b* as the fulcrum, for causing a gap between the press rollers 861*a* and 861*b*. Ends of the roller shafts 872*a* and 872*b* are projected outside from the frame 840 so as to fix gears 876 and 877. While gears 880, 879, and 878 are sequentially engaged, they are rotatably supported on the frame 840. The gear 878 is engaged with the gear 876, the gear 879 is engaged with the gear 877, and the gear 880 is engaged with a gear 881. The gear 881 is fixed to a gear shaft 882. As shown in FIG. 13, the gear shaft 882 is supported by the frame 840 via a bearing, and a gear 883 is fixed to the other end of the gear shaft 882. When the gear 883 is rotated, the press rollers 861*a* and 861*b* are rotated by transmitting rotary power via the gear trains. The rotating directions are the same with respect to the nipped bundle of sheets. The gear 883 is engaged with a rack gear 841 shown in FIGS. 8 and 10. The rack gear 841 is extended in parallel with the slide shafts 864 and 865 and is fixed to the base sheet metal 863.

Then, the timing belt 868 is rotated and run by rotation output from the motor M6 and the press holder 862 is moved while being supported by the slide shafts 864 and 865. With the movement, the gear 883 of the press holder 862 is rotated and moved while being engaged with the rack gear 841. The press rollers 861*a* and 861*b* are also rotated by rotation of the gear 883. The gear ratio of the gears is set in such a manner that the moving speed of the press holder 862 and the circumferential speed of the press rollers 861*a* and 861*b* are synchronous and uniform.

Figure 9:
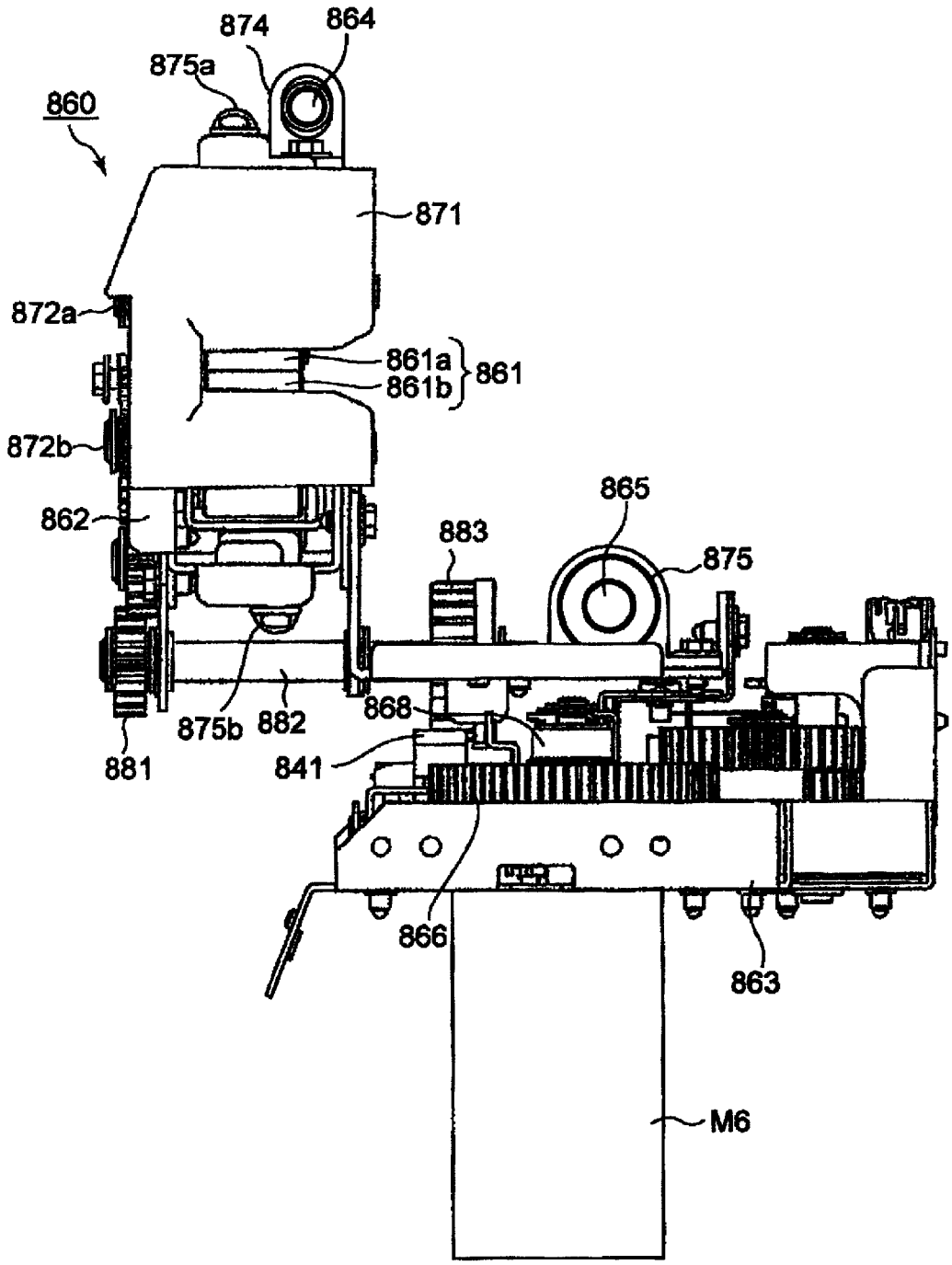
FIG. 9 is a front view of a fold press unit of the stitch bookbinding unit in FIG. 8.

As shown in FIGS. 8, 9, and 11, a sheet guide 871 with respect to the press rollers 861 is attached to the press holder 862. The sheet guide 871 can be omitted to easily describe it depending on the drawing.

By the above constitution, as shown in FIGS. 3 to 6, a bundle of folded sheets P subjected to the folding process is subject to the creasing process by the press rollers 861*a* and 861*b* so that the fold is reliable. Here, the target of the creasing process is not limited to the bundle of folded sheets subjected to the stitch binding process described in this embodiment. It is effective for an unbound bundle of folded sheets which is not subjected to the stitch binding process, and it is further effective for a folded sheet. In this embodiment, the creasing process is described by taking the constitution moving the press rollers 861*a* and 861*b* which constitute the "creasing unit" as an example. The "creasing unit" may be fixedly arranged to move the bundle of folded sheets in parallel with the fold. In other words, the "creasing unit" and the bundle of folded sheets are relatively moved for enabling the creasing process.

The stop state of the bundle of folded sheets P is held by one or more pairs of rollers for nipping the center portion of the sheet bundle width direction regardless of sheet size. The nip pressure F3 of the second fold conveying rollers 812 acts on the front edge of the bundle of folded sheets P and the nip pressure F2 of the first fold conveying rollers 811 acts on the rear edge thereof. The nip pressure F1 between the folding rollers 810*a* and 810*b* also acts thereon at the same time, depending on the length size of the bundle of folded sheets P in the conveying direction. Even if the bundle of folded sheets P is taken in the nip between the press rollers 861*a* and 861*b* so that a moment curling and rotating the bundle of folded sheets P occurs, the pairs of rollers can hold the bundle of folded sheets P without shifting it against the rotation moment.

When the folded portion at the front edge of the bundle of folded sheets P is subjected to the creasing process, the stop position at the front edge (press front edge position) of the bundle of sheets P is controlled so that the relative relation between the pair of press rollers 861 and the front edge of the bundle of folded sheets P is stayed constant irrespective of sheet size. That is, a sensor 884 arranged on the conveying guide 814 detects the front edge of the bundle of folded sheets P and transmits the detection signal from the finisher controlling portion 515 to the CPU circuit portion 150. The finisher controlling portion 515 controls movement of the press holder 862 including the press rollers 861*a* and 861*b* based on the operation signal in order to determine the stop position by communication with the CPU circuit portion 150.

In the rear edge position (press rear edge position) of the bundle of folded sheets P when subjected to the creasing process, the arrangement of the members is set so as not to interfere with storing of the succeeding sheet fed into the storing guide 803 due to projection of the rear edge of the bundle of folded sheets P into the storing guide 803. The straight line shortest distance of a guiding path 885 from a discharge portion 803*a* in which the bundle of sheets stored in the storing guide 803 is pushed and is discharged by the push-out member 830 to a downstream side surface 861*c* of the nip between the press rollers 861 is Ls (see FIG. 3). The straight line shortest distance Ls is set to be shorter than a conveying direction length L1 in the largest size of the bundle of folded sheets P to be subjected to the creasing process and Ls<L1. The start point of the guiding path 885 is the discharge portion 803*a* of the storing guide 803 and the end point thereof is the downstream side surface 861*c* of the press rollers 861*a* and 861*b*.

The guiding path 885 constituted by the conveying guides 813 and 814 is gently curved so as not to curl the bundle of folded sheets P. The distance of the guiding path 885 from the discharge portion 803*a* of the storing guide 803 through the folding rollers 810 and the conveying guides 813 and 814 to the downstream side surface 861*c* of the press rollers 861 is Lm. The distance Lm is set to be longer than the conveying direction length L1 in the largest size of the bundle of folded sheets P to be subjected to the creasing process and Lm>L1.

Figure 6:
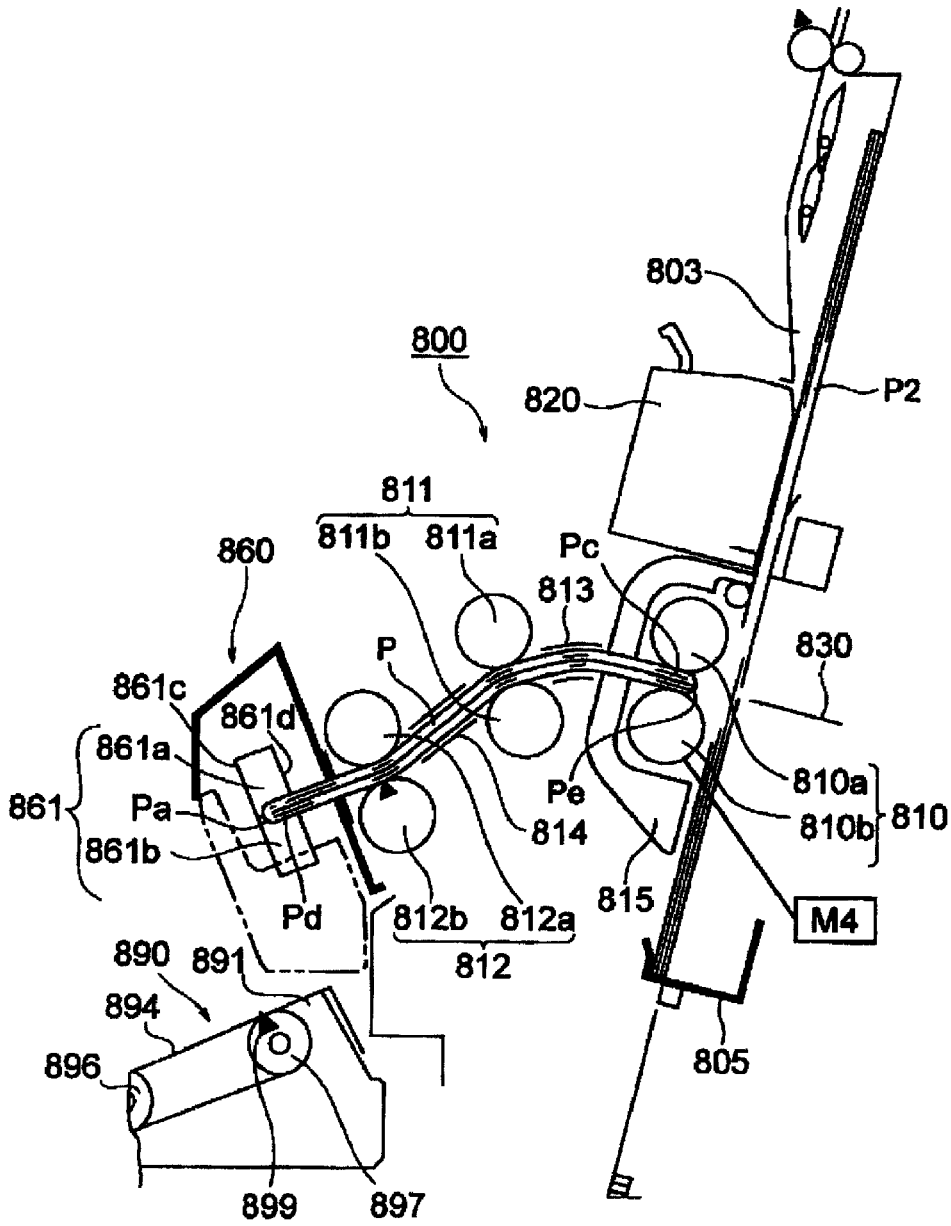
FIG. 6 is a state diagram when the stitch bookbinding unit conveys the folded sheet to a pair of press rollers.

As shown in FIG. 6, the press rollers 861*a* and 861*b* can position a front edge Pa as an edge of the folded portion of the bundle of folded sheets P near the downstream side surface 861*c* of the nip between the press rollers 861*a* and 861*b* to subject the bundle of sheets to the folding process. The press rollers 861*a* and 861*b* can position the front edge Pa near an upstream side surface 861*d* of the nip between the press rollers 861*a* and 861*b* to subject the bundle of sheets to the folding process. Further, the press rollers 861*a* and 861*b* can position the front edge Pa in an intermediate position therebetween. Preferably, the front edge of the bundle of folded sheets P is positioned in the intermediate position between the downstream side surface 861*c* and the upstream side surface 861*d* of the nip between the press rollers 861*a* and 861*b* to subject the bundle of sheets to the creasing process. It is therefore preferred that the distance between the intermediate position and the discharge portion 803*a* be longer than the L1 and that the straight line shortest distance between the intermediate position and the discharge portion 803*a* be shorter than the L1.

As described above, the guiding path 885 is set to Ls<L1. Also, since the conveying guides 813 and 814 are gently curved, the conveying guides 813 and 814 are arranged so as to be accommodated between the storing guide 803 (see FIG. 2) and the rear edge guide 710 by including the press holder 862.

From the above constitution and operation, the stitch bookbinding unit 800 of this embodiment can obtain the following effects.

For one effect, since the stitch bookbinding unit 800 is set to Ls<L1, the space between the folded bundle tray 890 and the fold press unit 860 in the vertical direction is used so that the fold press unit 860 can be overlapped above the folded bundle tray 890. Thereby, the device can shorten the length in the horizontal direction and can be smaller.

For another effect, since the stitch bookbinding unit 800 is set to Lm>L1, while the fold is subjected to the creasing process by the press rollers 861, a rear edge portion Pc as an opening of the bundle of folded sheets P shown in FIG. 6 cannot be opened and cannot remain in the storing guide 803 and the rear edge portion Pc cannot be curled. Therefore the rear edge portion Pc of the bundle of sheets subjected to the folding process cannot be opened and the look and quality of the bundle of sheets can be enhanced.

For a further effect, since the stitch bookbinding unit 800 is set to Lm>L1 the rear edge portion Pc of the bundle of sheets P cannot remain in the storing guide 803 and the succeeding sheet is sequentially received in the storing guide 803 as the fold of the bundle of folded sheets P is being strengthened. The stitch bookbinding unit 800 therefore can shorten the time interval performing the creasing process or the distance interval between the preceding bundle of sheets and the succeeding bundle of sheets, thereby drastically improving the sheet bundle process efficiency.

In the second fold conveying rollers 812 for discharging a bundle of sheets onto the folded bundle tray 890 on the most downstream side of the guiding path 885, a nip angle is determined so as to incline the bundle of sheets P downward and discharge it. It is because even when a large amount of sheets stacked on the stack tray 700 is lowered to near the folded bundle tray 890, the second fold conveying rollers 812 can discharge the bundle of folded sheets P without interfering with the lower side of the stack tray 700.

<<Folded Bundle Tray>>

The constitution and operation of the folded bundle tray 890 will be described with reference to FIG. 2.

The folded bundle tray 890 as a sheet bundle stacking portion consecutively has a first stacking surface 891, a second stacking surface 892, and a third stacking surface 893 and stacks a bundle of folded sheets discharged from the pair of second fold conveying rollers 812 as the sheet bundle discharge portions. When the first stacking surface 891 has a length stacking the bundle of folded sheets, the second stacking surface 892 and the third stacking surface 893 are not always necessary. When the second stacking surface 892 is not necessary, needless to say, a later-described second conveyor belt 895 is not necessary.

The first stacking surface 891 is spatially overlapped below the fold press unit 860 and downstream side in the sheet bundle conveying direction is inclined downward. The angle of inclination is set to be substantially equal to the angle of discharge of the second bundle conveying rollers 812. The top of the inclined plane of the first stacking surface 891 is raised to the height which does not interfere with the operation of the fold press unit 860 as high as possible. Thus, the fall distance from the second fold conveying rollers 812 to the first stacking surface 891 is set to be as short as possible. The second stacking surface 892 is bent from the inclined plane of the first stacking surface 891 and is disposed in the inclination direction opposite that of the first stacking surface 891 (the downstream side in the sheet bundle conveying direction is inclined upward). The third stacking surface 893 is disposed in parallel with the second stacking surface 892 via a step. It is preferred that the angle of inclination of the first stacking surface 891 has an angle of 20° to about 25° downward from the horizontal plane. It is also preferred that the angle of inclination of the second stacking surface 892 has an angle of 10° to about 15° upward from the horizontal plane.

The first stacking surface 891 and the second stacking surface 892 have first and second conveyor belts 894 and 895 as sheet bundle moving members for transferring a stacked bundle of folded sheets. Both one end of the first conveyor belt 894 and one end of the second conveyor belt 895 are engaged onto a drive pulley 896 near the bent portion. The other end of the first conveyor belt 894 is engaged onto an idler pulley 897 and the other end of the second conveyor belt 895 is engaged onto an idler pulley 898. The first and second conveyor belts 894 and 895 can perform normal and reverse rotation by a conveyor motor M7 coupled to the shaft of the drive pulley 896 in the same direction.

The first stacking surface 891 is provided with a sheet bundle detecting sensor 899 which can detect the bundle of folded sheets P stacked just below the operating region of the fold press unit 860. The sheet bundle detecting sensor 899 detects the stacking position of the bundle of folded sheets to be discharged. The third stacking surface 893 is drawably accommodated under the second stacking surface 892. When the third stacking surface 893 is accommodated in the dashed line position, a storing box 850 having a height from the floor surface to the idler pulley 898 can be placed on the floor and thereby the number of the bundles of folded sheets stacked can be increased.

Figure 26:
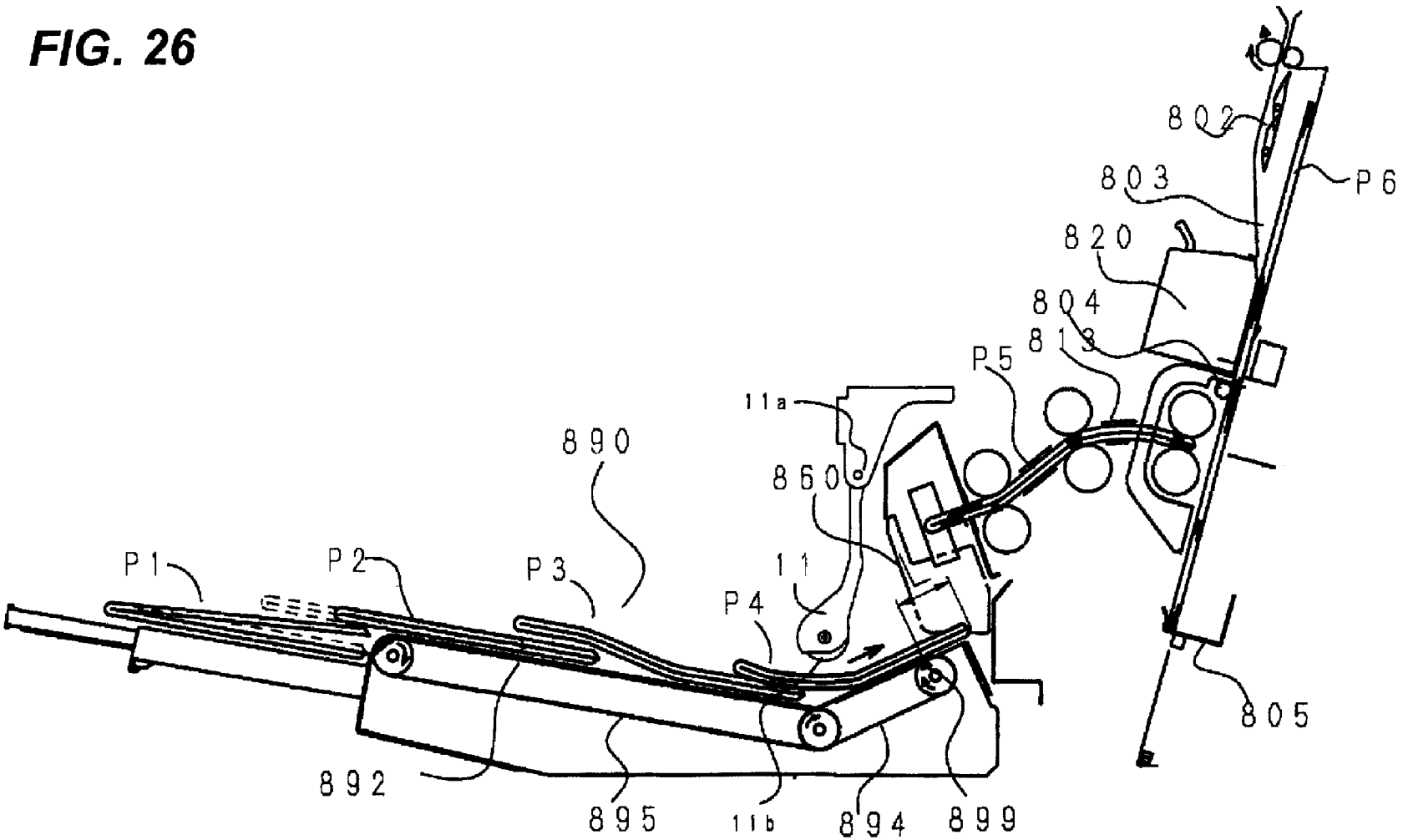
FIG. 26 is a state diagram when a head bundle of folded sheets is stacked on the tray.

As shown in FIG. 2, a sheet bundle retainer 11 is provided above the folded bundle tray 890 on the downstream side of the press unit 860. As shown in FIG. 26, the sheet bundle retainer 11 can be rotated in a predetermined amount, with a rotation axis 11*a* as the fulcrum and a rotatable roller 11*b*. The sheet bundle retainer 11 prevents the last bundle of sheets indicated by the reference symbol P4 in FIG. 26 stacked on the folded bundle tray 890 from being opened and the next bundle of sheets indicated by the reference symbol P5 from slipping into an opening of the last bundle of sheets P4 as the preceding bundle of sheets.

<<Inserter>>

The constitution of the inserter 900 equipped in the upper portion of the finisher 500 will be described with reference to FIG. 1.

The inserter 900 is a device for inserting a sheet (insert sheet) different from a normal sheet in a first, last, or middle page of the sheet on which an image formed by the printer portion 300. The first and last insert sheets are cover sheets.

The inserter 900 feeds the sheet set on insert trays 901 and 902 by the user to any one of the sample tray 701, the stack tray 700, and the folded bundle tray 890 without passing it through the printer portion 300. The inserter 900 sequentially separates each sheet in a bundle of sheets stacked on the insert trays 901 and 902 and feeds it into the conveying path 520 with desired timing.

Here, the stitch bookbinding operation in the stitch bookbinding unit 800 will be described with reference to FIGS. 3 to 7 and FIGS. 17 to 28.

The stitch bookbinding mode is set by operation of the user and the sheet P formed with an image is sequentially discharged from the discharge rollers 118 of the printer portion 300 shown in FIG. 1. The sheet P passes through the folding process portion 400 so as to be delivered to the inlet side rollers 501 shown in FIG. 2, and is then fed into the lower sheet-discharge path 522 via the conveying path 520. The sheet is switched to the right side by the switching flapper 514 provided midway on the lower sheet-discharge path 522 and passes through the saddle sheet-discharging path 523 so as to be fed into the stitch bookbinding unit 800.

As shown in FIG. 3, the sheet is delivered to the saddle inlet side rollers 801. Its convey-in inlet is selected by the flapper 802 operated by a solenoid according to size and sheet is conveyed into the storing guide 803 of the stitch bookbinding unit 800. The sheet then receives the conveying force of the sliding roller 804 and strikes onto the sheet positioning member 805 previously stopped in the position suitable for the sheet size, thereby performing positioning in the conveying direction.

The pair of aligning plates 815 in standby in the positions without interfering with feeding of the sheet into the storing guide 803 nips and aligns the sheet, thereby aligning both-side edges of the sheet. The lower edge and both-side edges of the sheet are thus aligned.

Figure 4:
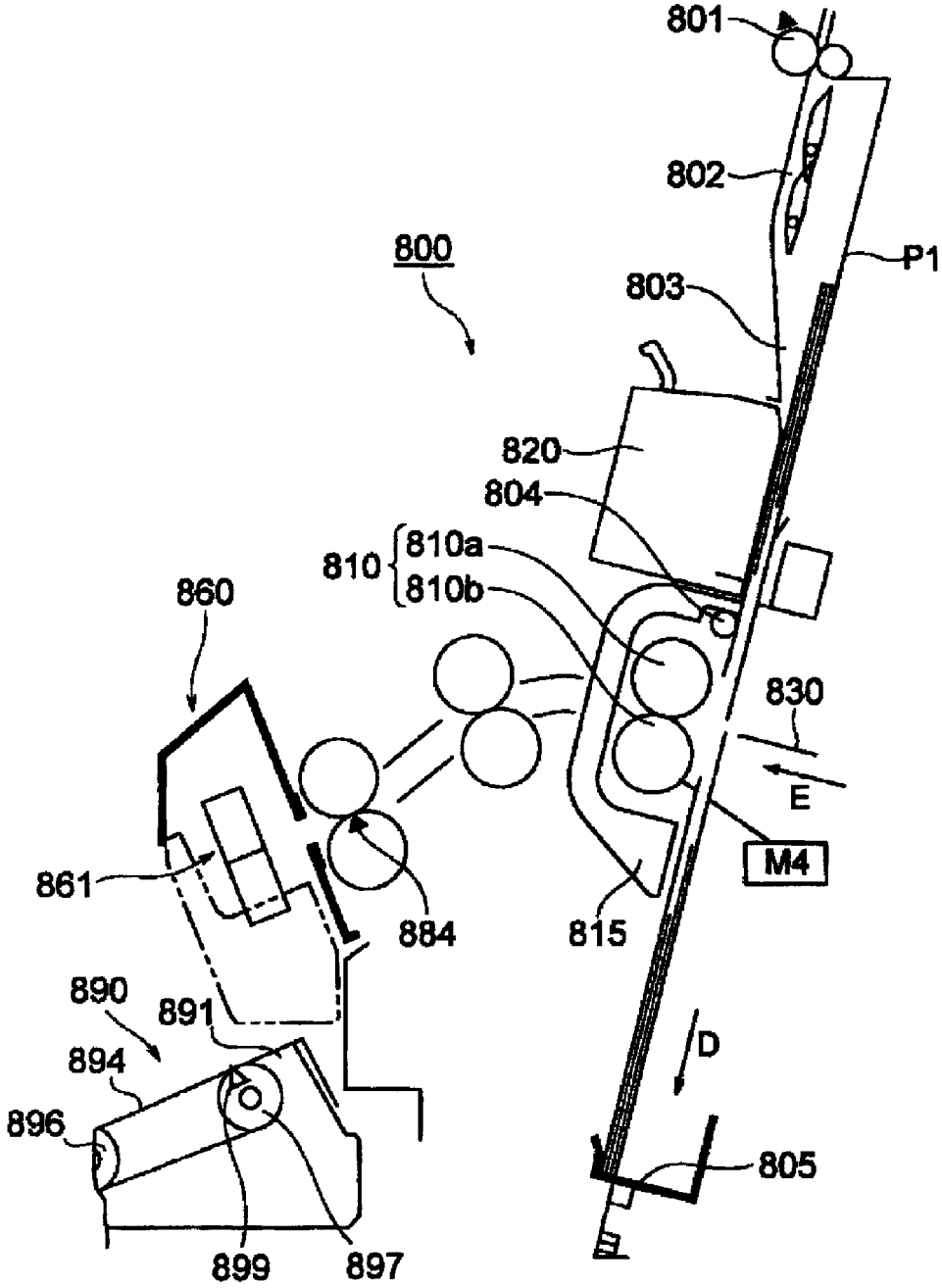
FIG. 4 is a diagram showing the state that the binding position of the bundle of sheets stored in the storing guide of the stitch bookbinding unit starts to be folded.

The sheet storing and aligning operations are performed each time the sheet P is fed into the storing guide 803. When the alignment of the last sheet is completed, the stapler 820 staples the center portion of the bundle of sheets stored in the storing guide 803 in the conveying direction. As shown in FIG. 4, the stapled bundle of sheets is moved to the lower side (an arrow D direction) with lowering of the sheet positioning member 805. The sheet positioning member 805 is stopped in the position in which the center portion, that is, the stapled position, of the bundle of sheets is opposite the nip between the pair of folding rollers 810.

Figure 5:
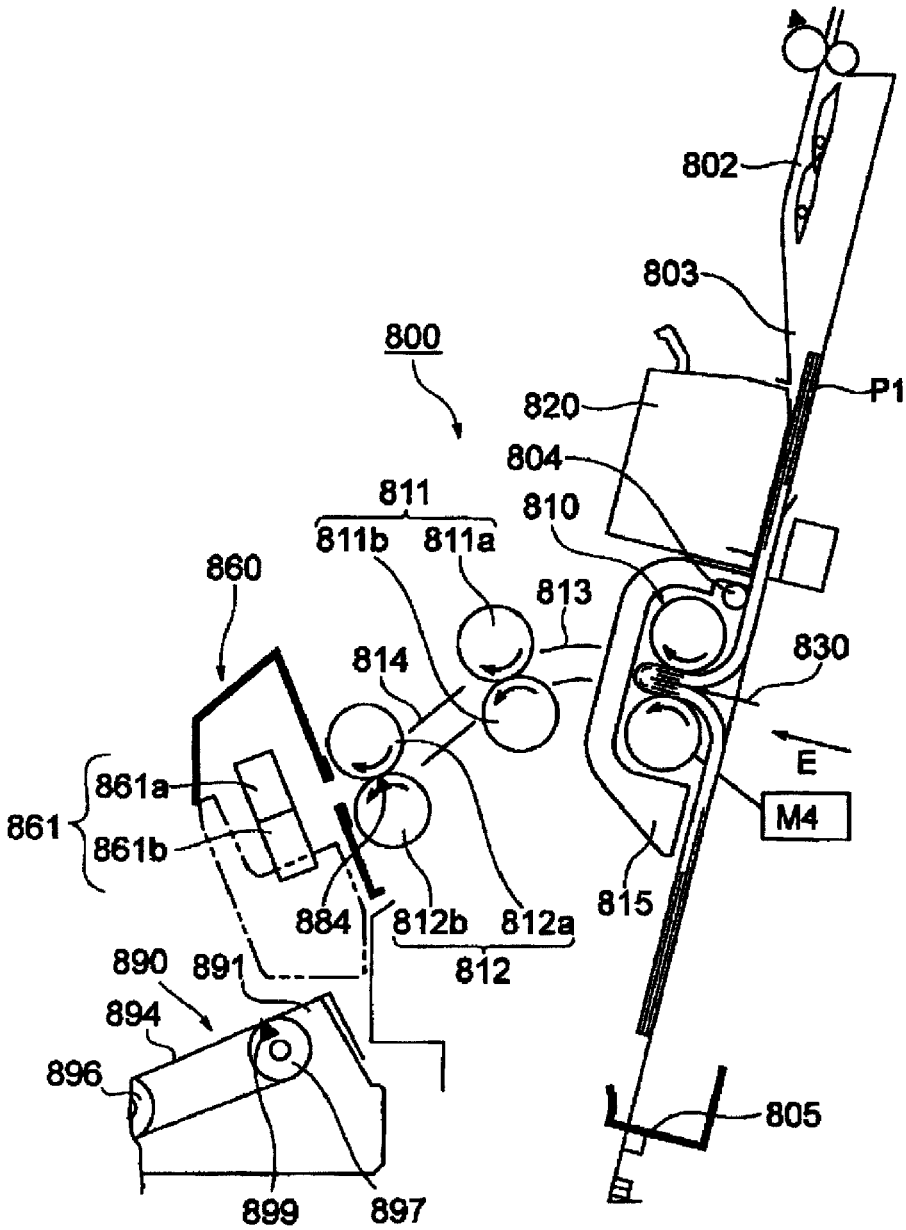
FIG. 5 is a state diagram when the stitch bookbinding unit starts to fold the bundle of sheets.

The push-out member 830 in standby in the standby position starts to move to the nip (an arrow E direction) between the folding rollers 810 and pushes the center portion of the bundle of sheets P into the nip between the folding rollers 810 while spreading out the folding rollers 810 by force. As shown in FIG. 5, the folding rollers 810 nip the bundle of sheets P, and convey it while being rotated, and fold it into two. In addition to the folding rollers 810, the first fold conveying rollers 811 and the second fold conveying rollers 812 are also rotated in the arrow direction upon reception of drive of the motor M4 shown in FIG. 2. The pairs of rollers 810, 811, and 812 convey the bundle of sheets with the folded portion of the bundle of folded sheets P as the head. The bundle of folded sheets is conveyed in the conveying guides 813 and 814.

As shown in FIG. 6, when the bundle of sheets P is conveyed to the position which can be nipped by the press rollers 861, the front edge Pa is detected by the sensor 884 shown in FIG. 2. When the motor M4 stops the operation, conveying is also stopped and a front edge portion Pd as the folded portion of the bundle of folded sheets P is held by the second fold conveying rollers 812 and the rear edge thereof is held by the first fold conveying rollers 811. The bundle of folded sheets P is also held by the pair of folding rollers 810 according to the size (length in the conveying direction) of the bundle of folded sheets. The pairs of rollers 812, 811, and 810 nip the bundle of sheets in the positions symmetrical with respect to its width direction. When the push-out member 830 completes push-out of the bundle of sheets, it is retreated to the saving position again. The front edge portion Pd as the folded portion includes the front edge Pa.

Figure 17:
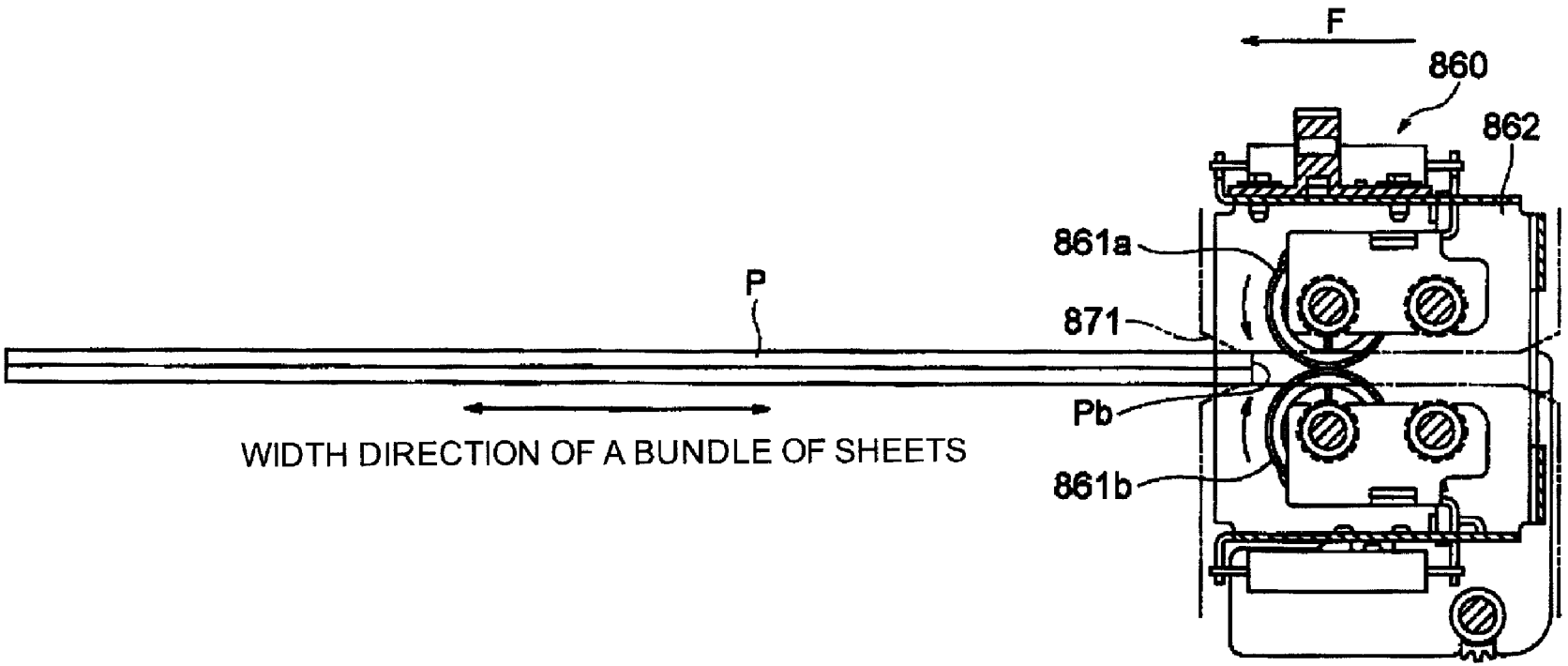
FIG. 17 is a diagram when the pair of press rollers of the stitch bookbinding unit is about to start an operation for reliably folding the folded portion of the folded sheet.
Figure 18:
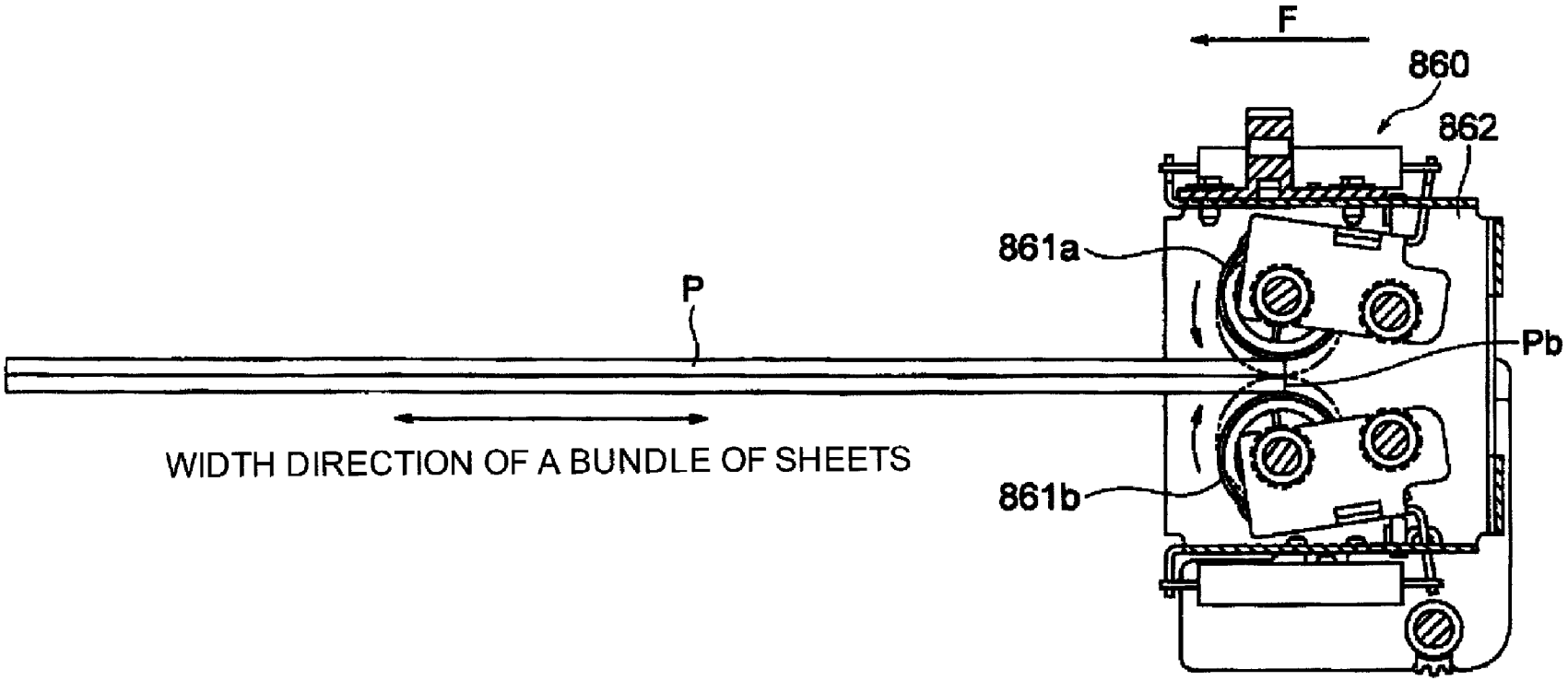
FIG. 18 is a diagram when the pair of press rollers of the stitch bookbinding unit starts the operation for reliably folding the folded portion of the folded sheet.
Figure 19:
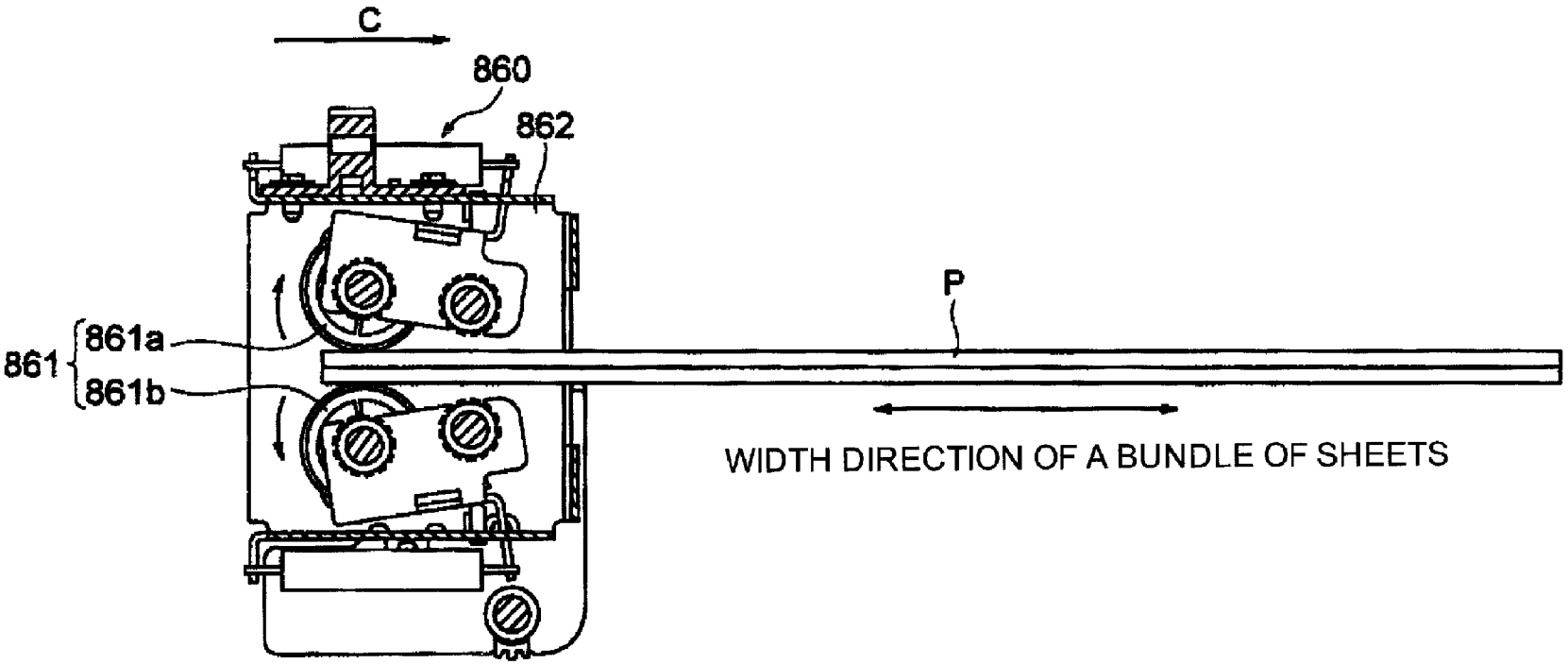
FIG. 19 is a diagram when the pair of press rollers of the stitch bookbinding unit complete pressing of the folded portion of the folded sheet.

As shown in FIG. 17, prior to conveying of the bundle of folded sheets P by the pairs of rollers 812, 811, and 810, the press holder 862 is in standby in the standby position (back side) according to the size (width direction) of the bundle of folded sheets P. When the stop of the bundle of folded sheets P is completed so that the folded portion of the bundle of folded sheets P is inserted into the sheet guide 871 (chain dash), the motor M6 is started. While rotating the pair of press rollers 861, the fold press unit 860 starts to move from the back side of the device to the front side (an arrow F direction or the width direction of the bundle of folded sheets).

The pair of press rollers 861 is brought into contact with a side edge portion Pb along the sheet conveying direction of the bundle of folded sheets P stopped and held. The press rollers 861*a* and 861*b* are rotated together, and receive the side edge portion Pb of the bundle of folded sheets P to smoothly ride on the side edge portion for nipping the folded portion shown in FIG. 18. Even when the thickness of the bundle of folded sheets is increased, the press rollers 861*a* and 861*b* are still in synchronization with the movement of the press holder 862 so as to nip the bundle of folded sheets P without response delay. Therefore the press rollers 861 can fold the folded portion of the bundle of folded sheets P without damaging it due to tearing, wrinkling, and roller trace. The press rollers 861 also enable feeding by intermittent movement which is temporarily stopped while pressing the fold of the sheet along the fold and its operation is controlled by the finisher controlling portion 515 as the controlling unit. As described above, the "creasing process" is not limited to the constitution moving the press rollers 861. The press rollers 861 may be fixedly arranged so as to move the folded portion of the bundle of folded sheets P with respect to the press rollers 861. When both the press rollers 861 and the bundle of folded sheets P are moved, the processing time is shortened. In other words, the press rollers 861 and the bundle of folded sheets P are relatively moved so that the "creasing process" according to the present invention can be realized.

Figure 20:
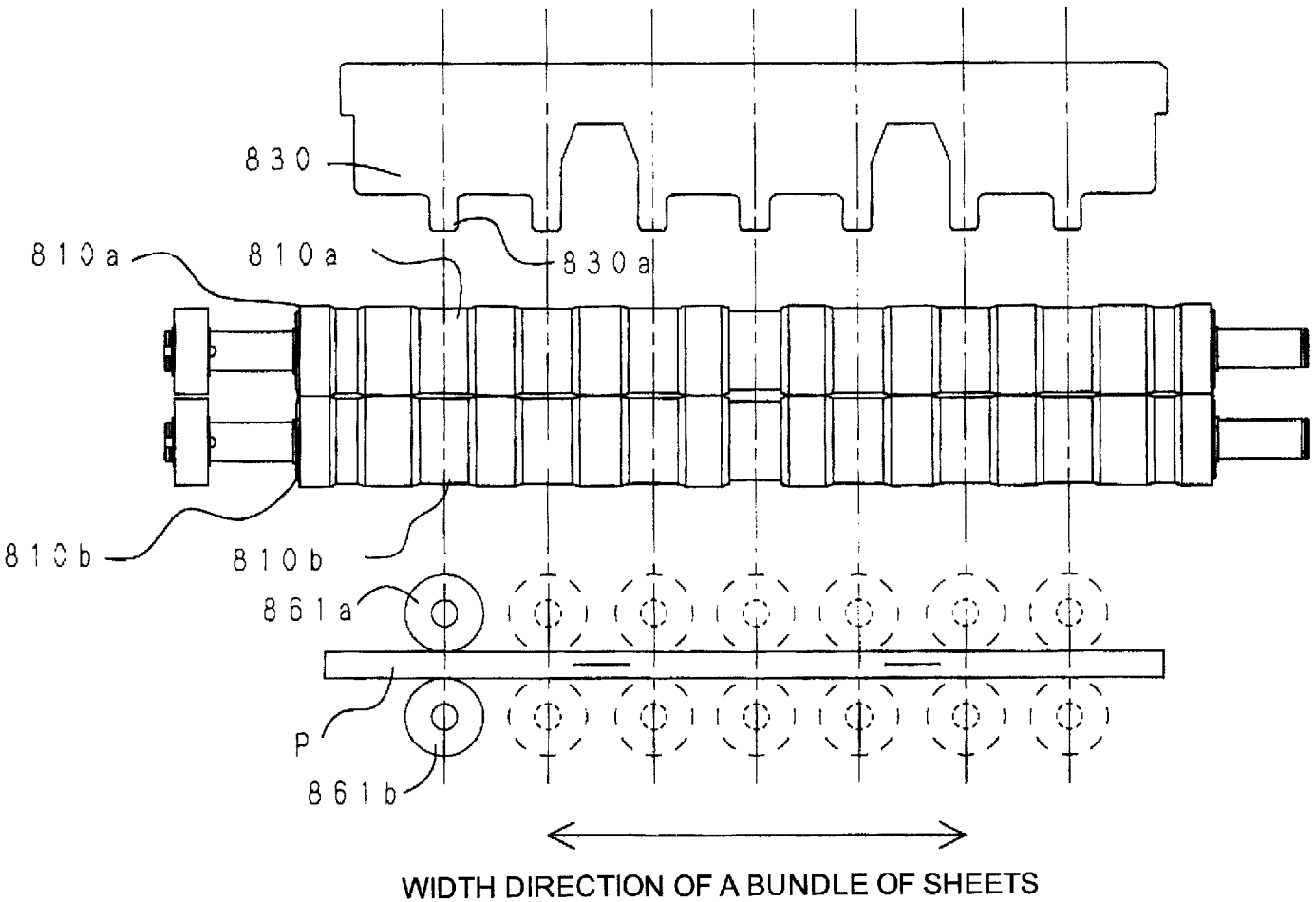
FIG. 20 is a diagram showing stop positions of the pair of press rollers in the folded portion of the folded sheet.

FIG. 20 shows the stop state (positions) of the press rollers 861. The respective positions indicated by solid lines and dashed lines in the drawing are press roller stop positions and the press rollers 861 are stopped in the positions corresponding to the concave portions 810*a* and 810*b* of the folding rollers 810 in comb shape.

At a stage before the fold of the bundle of sheets bookbound is pressed by the press rollers 861, the bundle of sheets is folded to some degree by the folding rollers 810 as the folding process portions. A pressing force is hard to be applied to a portion nipped between the concave portions so that the folding to the bundle of sheets is weak. In order that the folded portion is folded more strongly for fixing folding, the press rollers 861 are temporarily stopped in the position shown in FIG. 20 for a predetermined time. Such means and method are only an example, it is not limited to the stop position of the press rollers 861 and the stop point and the stop time can be changed, if necessary. As described later, it is effective that at least one of sheet conditions of the size, the kind of the sheet and the number of sheets forming the bundle of sheets is changed, however, it is desired that the stop point and the stop time be determined from the balance with the processing time. It is also effective that the stop time is changed according to the stop position. For example, the stop time in the stop position near the center in the fold length direction is longer than that in the stop position at the edge in the length direction, thereby making the fold stronger. When there are many stop positions, it is effective that the stop time in the stop position immediately after the start of the folding process operation and the stop time in the stop position immediately before the end of the operation, other than the stop position near the center portion mentioned above, are set to be longer.

Figure 21:
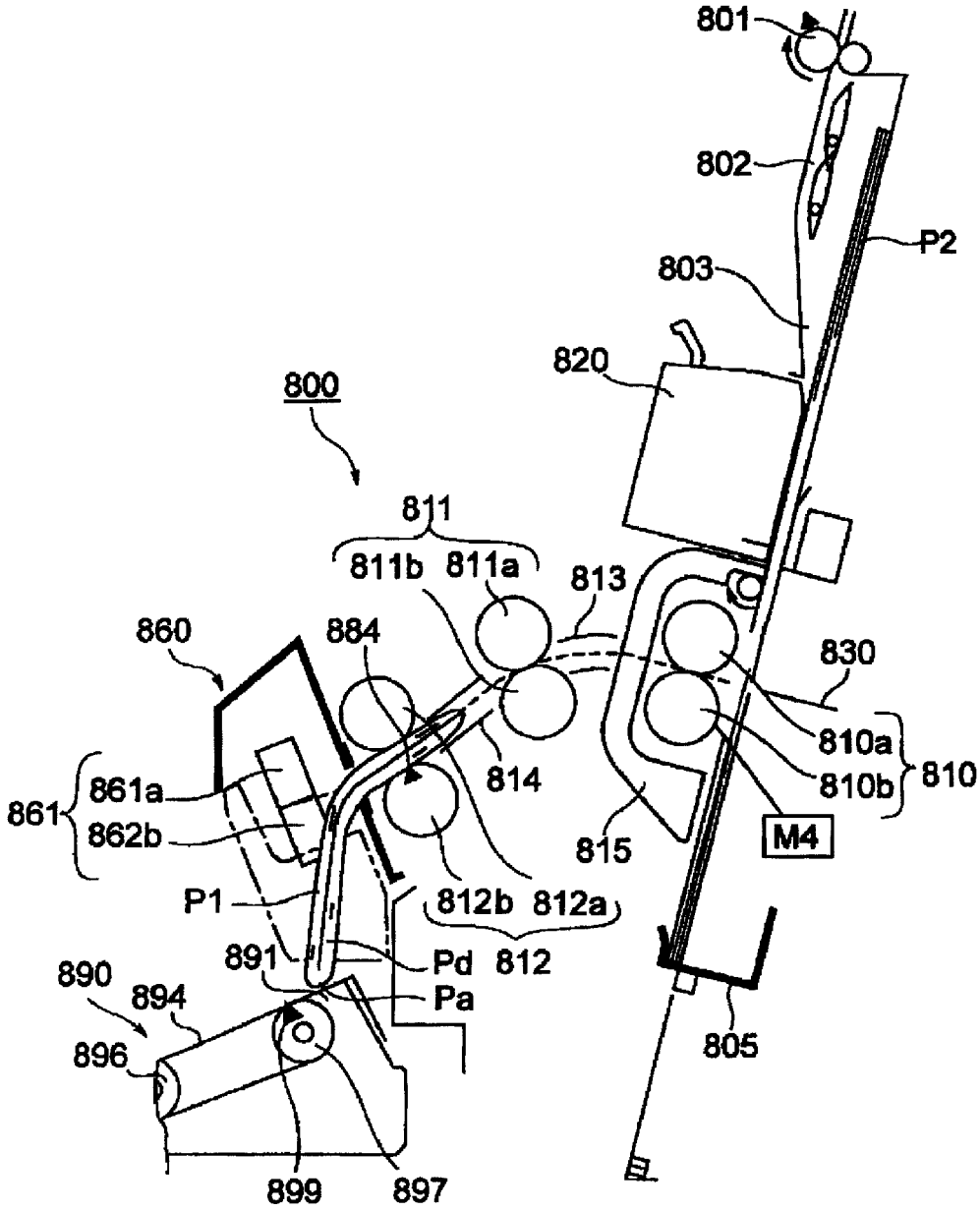
FIG. 21 is a state diagram in which the bundle of folded sheets is discharged by a pair of second fold conveying rollers of the stitch bookbinding unit.

After the creasing process by the press rollers 861 is completed, the press rollers 861 moves to the outside in the sheet bundle width direction to stop and open the path of a bundle of folded sheets P1 in the conveying direction. As shown in FIG. 21, the stopped bundle of folded sheets P1 (the reference symbol is changed from P to P1 for discriminating the preceding bundle of sheets and the succeeding bundle of sheets) starts to be conveyed by the motor M4 again and is then discharged by the second fold conveying rollers 812 onto the folded bundle tray 890. The front edge portion Pd of the bundle of sheets P1 hangs down under its own weight in the discharge process and is then delivered to the first stacking surface 891. The first stacking surface 891 is inclined at an angle substantially equal to the sheet bundle discharge angle of the second fold conveying rollers 812 near the second fold conveying rollers 812. The bundle of folded sheets P1 is smoothly delivered to the first stacking surface 891. The bundle of folded thin sheets having a low stiffness can be stably discharged without causing any disadvantages such as buckling and curling due to landing of the front edge portion Pd of the bundle of sheets on the first stacking surface 891.

Figure 22:
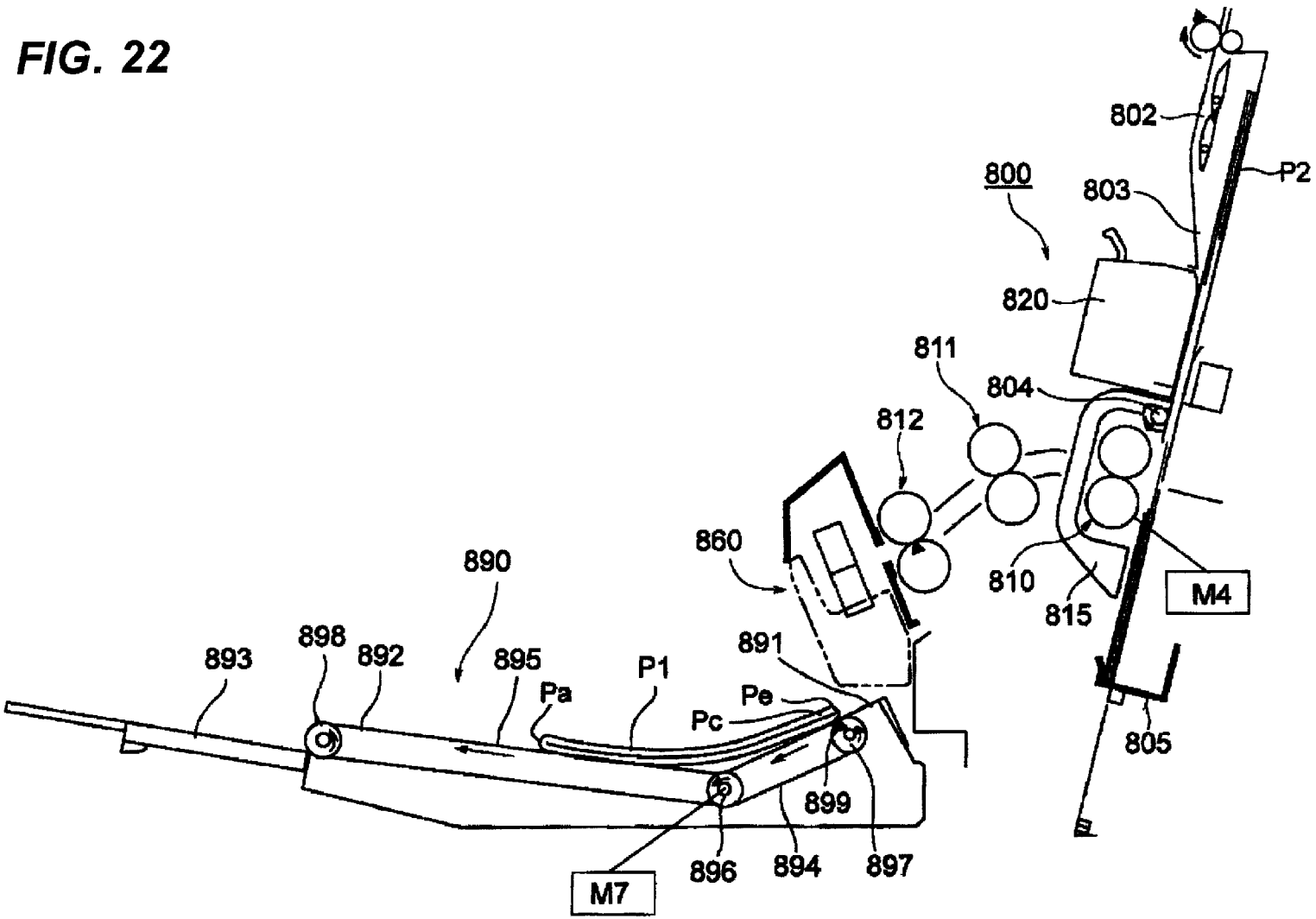
FIG. 22 is a state diagram in which a preceding bundle of folded sheets is stacked on a folded bundle tray.

As shown in FIG. 22, the first and second conveyor belts 894 and 895 start rotation to the downstream side in the sheet conveying direction by the conveyor motor M7 with predetermined timing and then transfer the bundle of folded sheets P1 discharged onto the folded bundle tray 890 to the downstream side. When the bundle detecting sensor 899 detects a rear edge Pe of the bundle of folded sheets P1, the conveyor motor M7 stops rotation. The rear edge portion Pc as an opening includes the rear edge Pe. Since the bundle detecting sensor 899 is arranged just below the operation region of the fold press unit 860, the entire stopped bundle of folded sheets P1 including the rear edge portion Pc is located outside the operating region (a first stacking position) of the fold press unit 860.

While the preceding bundle of folded sheets P1 is being discharged onto the folded bundle tray 890, the discharge and alignment operations are performed to the next (succeeding) bundle of folded sheets P2. The creasing process by the fold press unit 860 is executed to the succeeding bundle of folded sheets P2 in the same manner. The preceding bundle of folded sheets P1 is stacked in the first stacking position and cannot be a hindrance in the creasing process by the press unit 860 due to interference with it. The preceding bundle of folded sheets P1 is conveyed to the first stacking position so as to be reliably separated from the wall surface formed in the lower side of the pair of second fold conveying rollers 812 thereby no curl due to leaning of the rear edge portion Pc on the wall surface can occur.

Figure 23:
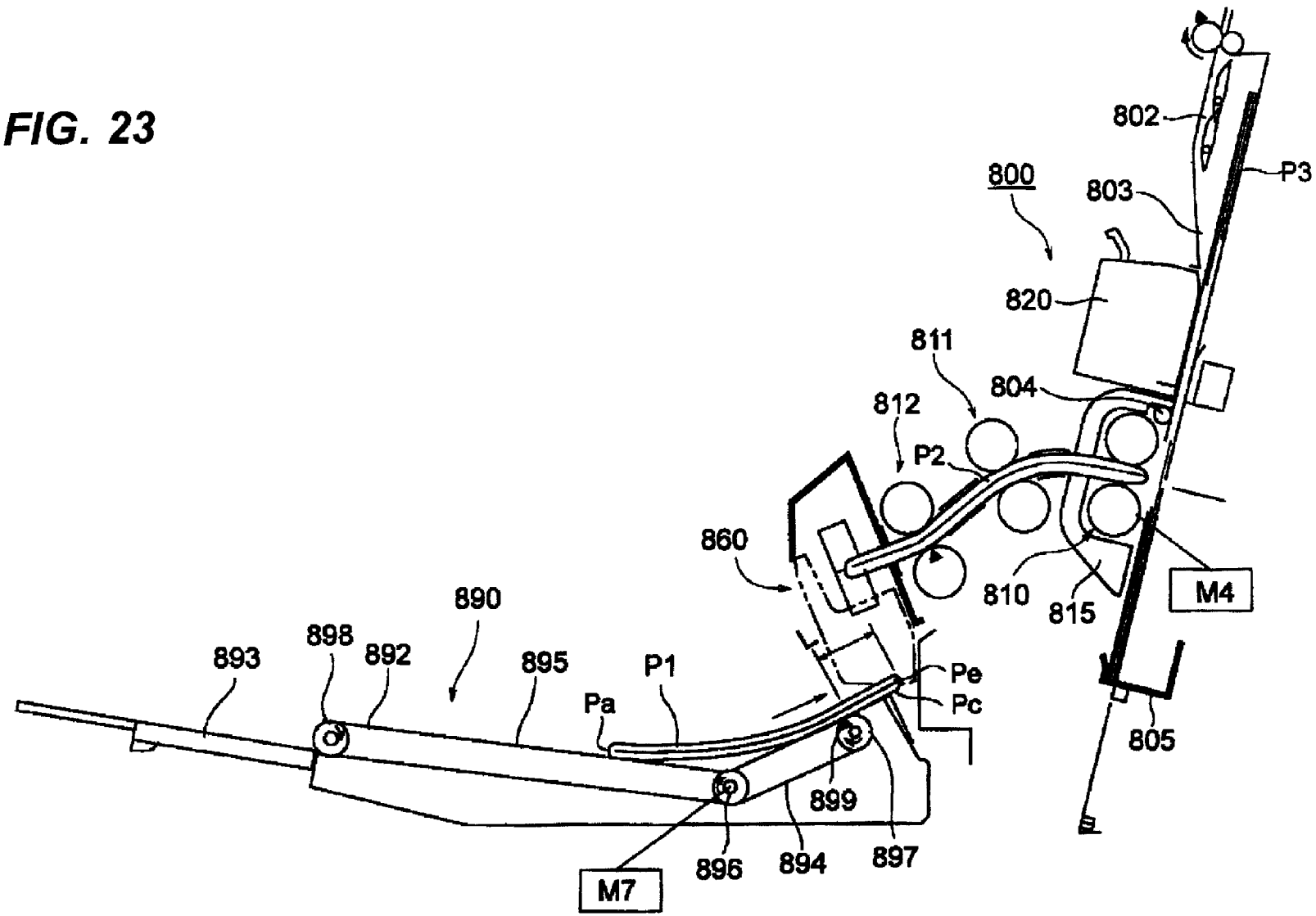
FIG. 23 is a state diagram in which the preceding bundle of folded sheets is pulled back to the upstream side.

As shown in FIG. 23, when the fold press unit 860 completes the folding process of the succeeding bundle of folded sheets P2, the first and second conveyor belts 894 and 895 are rotated to the upstream side in the sheet conveying direction by the conveyor motor M7. The preceding bundle of folded sheets P1 in the first stacking position is moved by a predetermined distance L so as to approach the pair of second fold conveying rollers 812. The position is a second stacking position.

Figure 24:
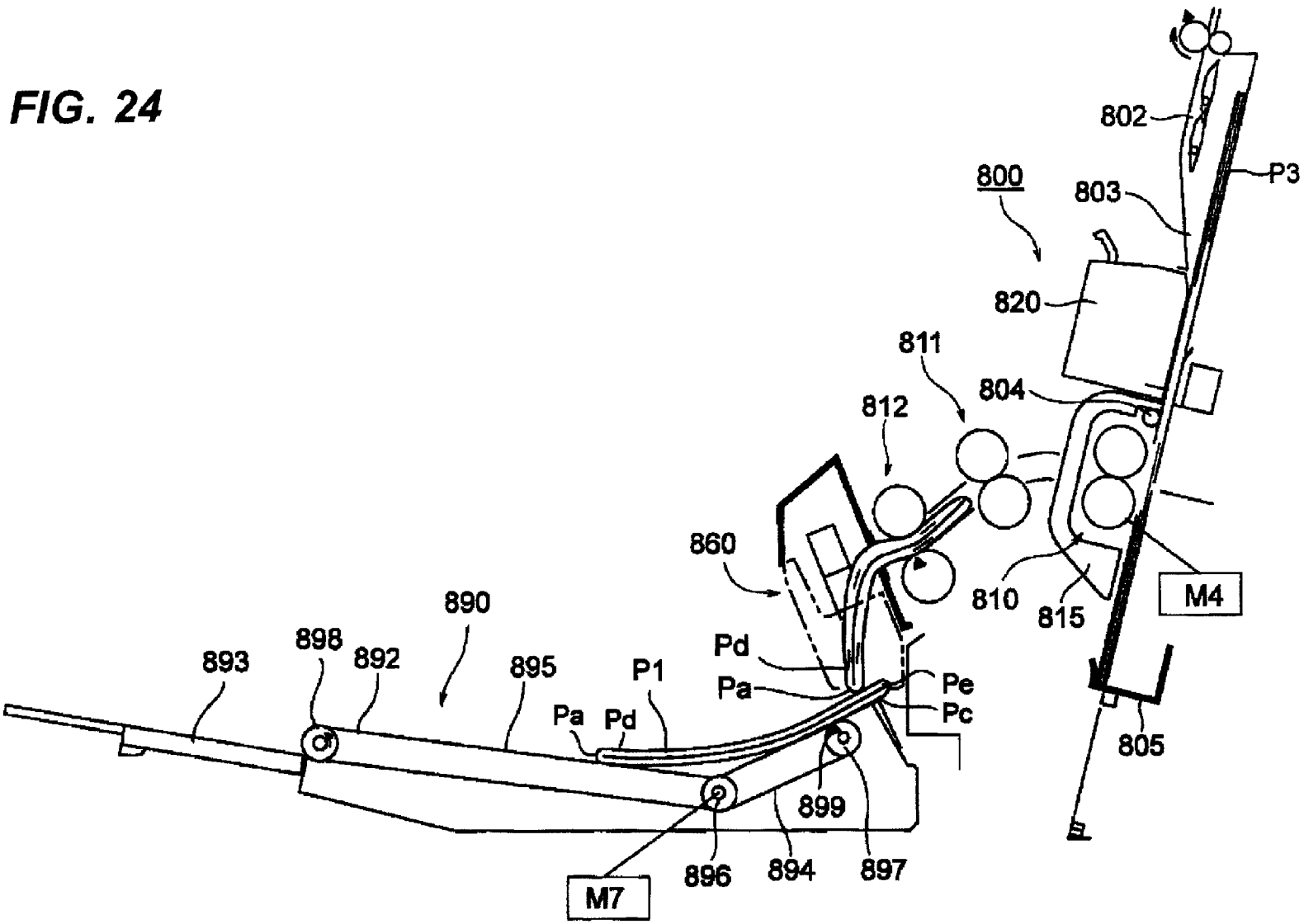
FIG. 24 is a state diagram when a succeeding bundle of folded sheets is about to start to be stacked on the preceding bundle of center portion folded sheets.

As shown in FIG. 24, when the motor M4 is rotated again, the succeeding bundle of folded sheets P2 is discharged from the second fold conveying rollers 812. The front edge portion Pd of the succeeding bundle of folded sheets P2 hangs down under its own weight. The rear edge Pe of the preceding bundle of folded sheets P1 in the second stacking position is located on the upstream side than the front edge Pa of the succeeding bundle of folded sheets P2. Therefore the succeeding bundle of folded sheets P2 is stacked while sliding on the top surface of the bundle of folded sheets P1.

As is apparent from the above, the stitch bookbinding unit 800 of this embodiment moves the preceding bundle of folded sheets P1 to the second stacking position and then discharges the succeeding bundle of folded sheets P2 onto the preceding bundle of sheets P1. The action of the sheet bundle retainer 11 prevents the front edge Pa of the succeeding bundle of folded sheets P2 from slipping into the rear edge portion Pc as an opening of the preceding bundle of folded sheets P1. The succeeding bundle of folded sheets P2 is therefore stably stacked so as to be shifted in such a manner that the front edge Pa of the succeeding bundle of folded sheets P2 presses the rear edge portion Pc of the preceding bundle of folded sheets P1 from above without causing any disadvantages such as getting caught in the preceding bundle of folded sheets P1.

While the succeeding bundle of folded sheets P2 is being discharged, the first and second conveyor belts 894 and 895 are rotated in the direction conveying the bundle of sheets to the downstream side. The preceding and succeeding bundles of folded sheets P1 and P2 are then stacked so as to be shifted in such a manner that the front edge Pa of the succeeding bundle of folded sheets P2 presses the rear edge portion Pc of the preceding bundle of folded sheets P1 from above.

Figure 25:
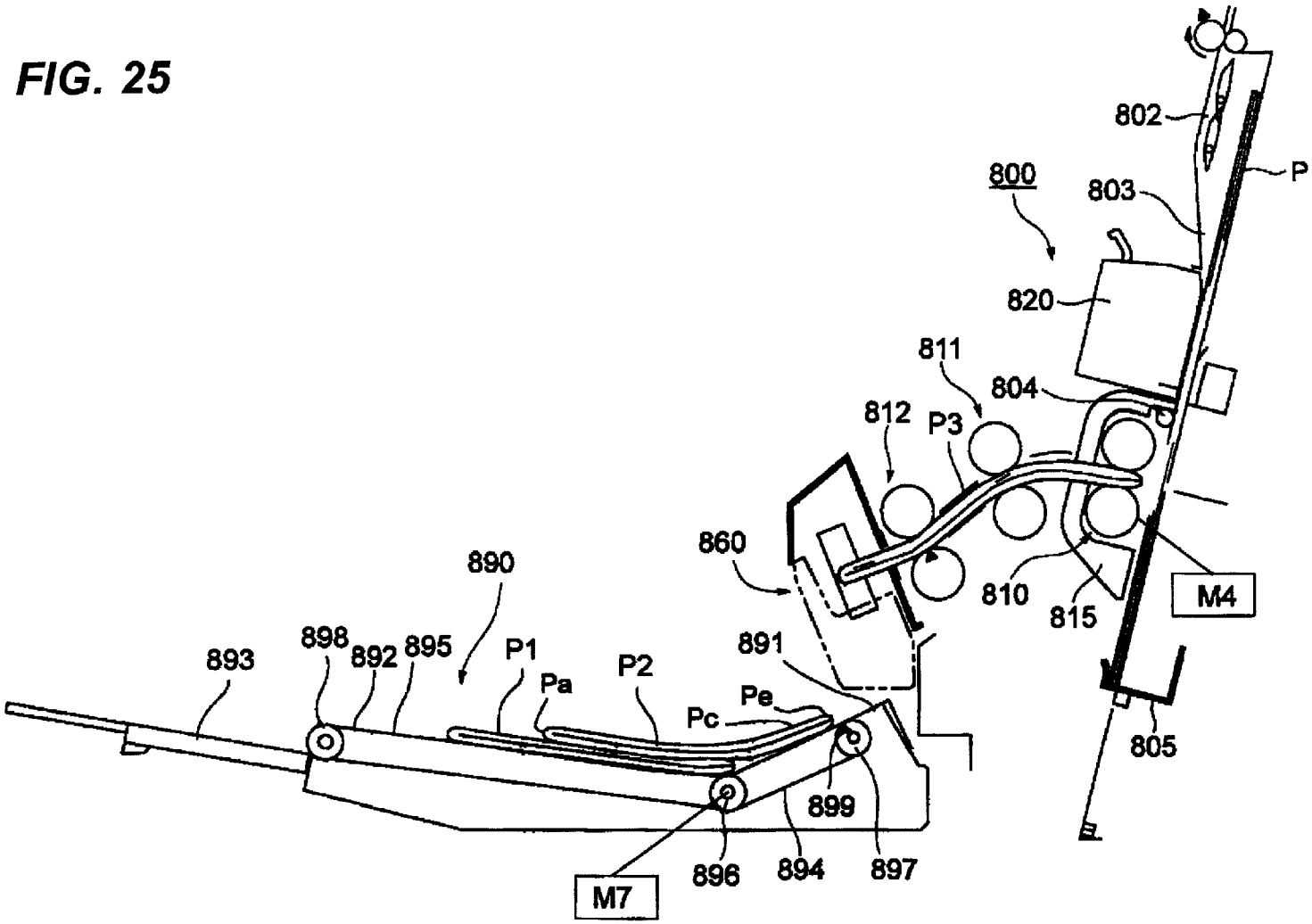
FIG. 25 is a state diagram when the succeeding bundle of folded sheets is stacked on the preceding bundle of center portion folded sheets.

As shown in FIG. 25, when the bundle detecting sensor 899 detects the rear edge Pe of the succeeding bundle of folded sheets P2, the first and second conveyor belts 894 and 895 are reversely rotated and driven by operation control based on the detection signal. The preceding and succeeding bundles of folded sheets P1 and P2 are then moved to the upstream side and are stopped when the succeeding bundle of folded sheets P2 reaches the first stacking position. This operation is repeated to a further succeeding bundle of folded sheets P3 up to the last bundle of folded sheets. A desired number of bundles of folded sheets P are orderly stacked so as to be shifted on the folded bundle tray 890. When the number of stacked bundles of folded sheets increases, the first bundle of folded sheets P1 runs up the second stacking surface 892 inclined to the downstream side in the discharge direction.

Figure 31:
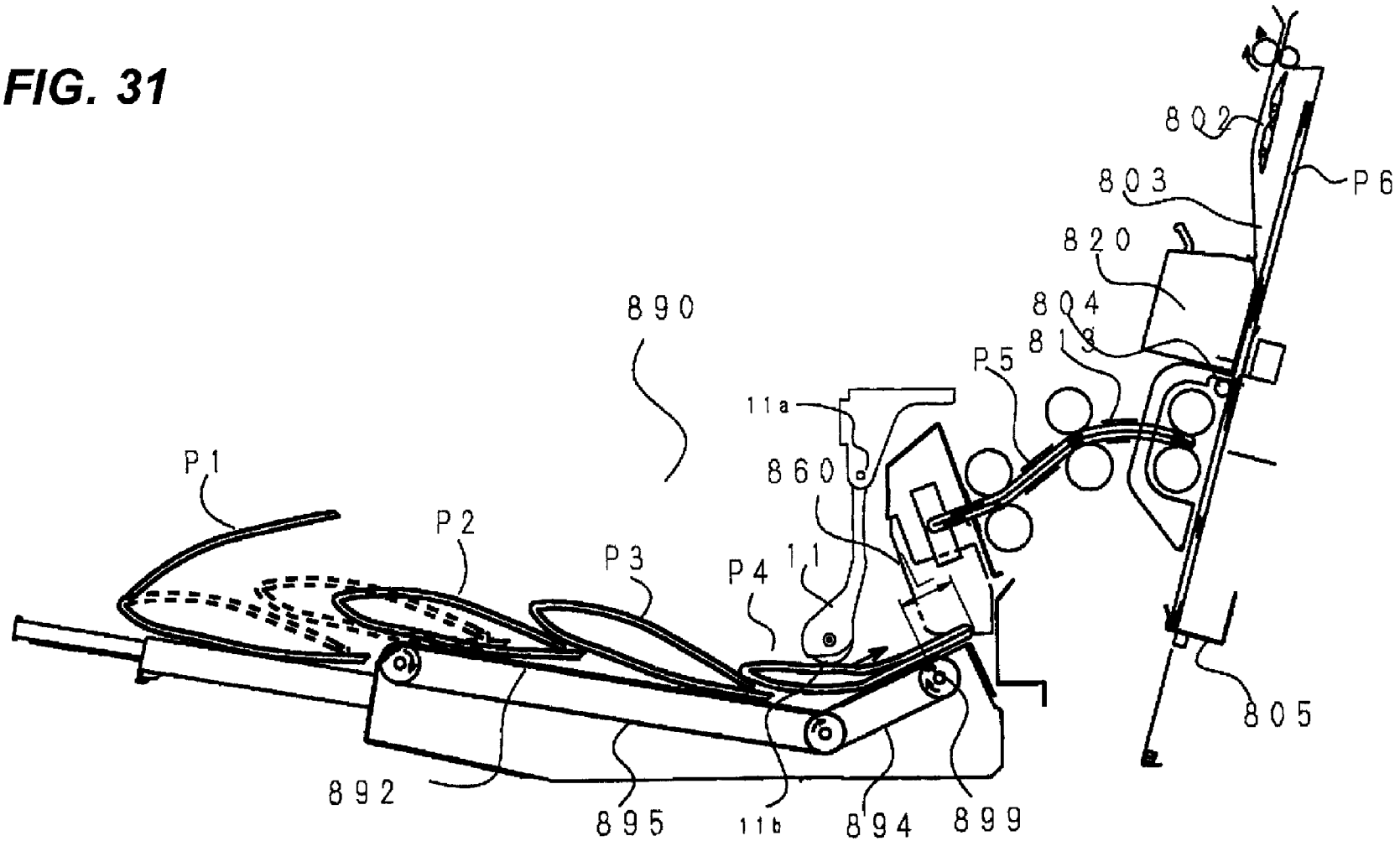
FIG. 31 is a state diagram when the next bundle of folded sheets slips into the head bundle of folded sheets.
Figure 32:
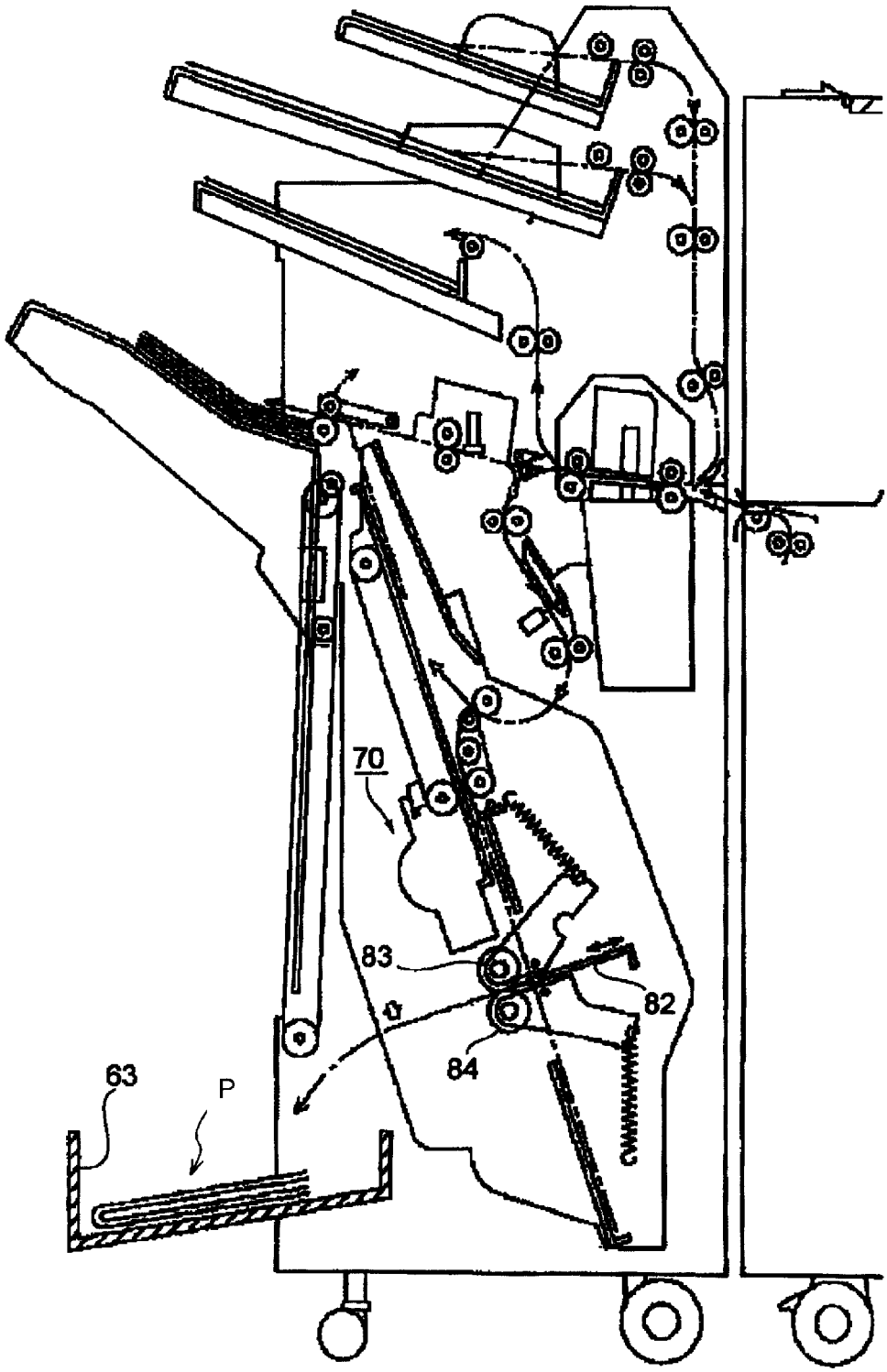
FIG. 32 is a front view of a related art sheet processing apparatus.
Figure 33:
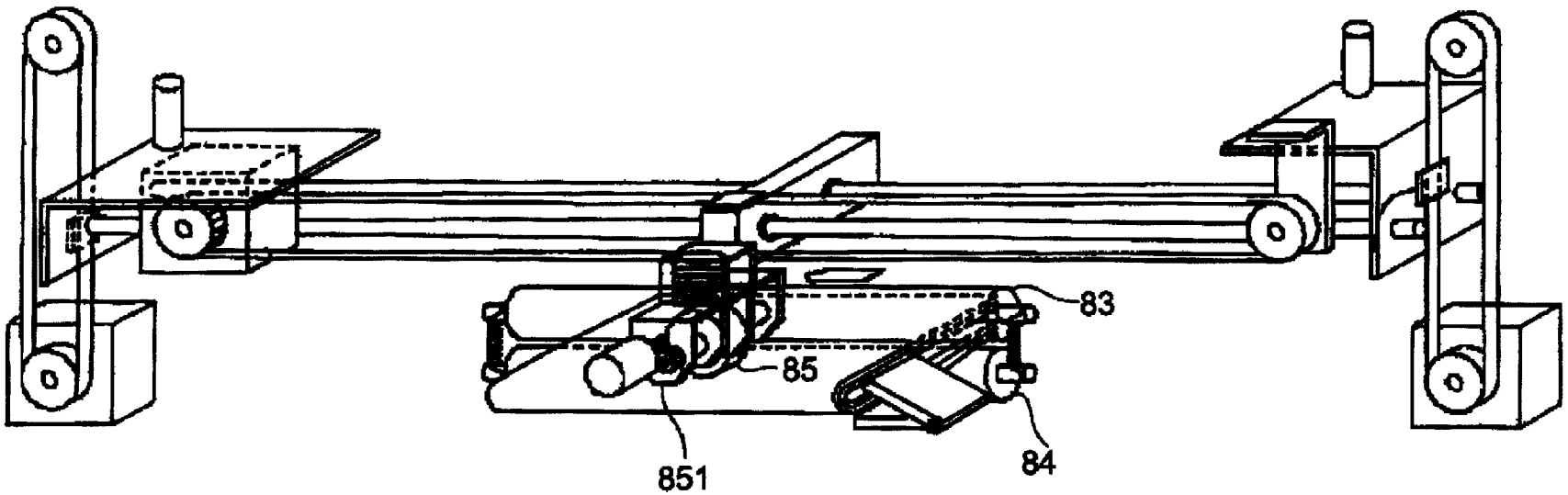
FIG. 33 is a perspective view of the driving mechanism of a second folding roller in the related art sheet processing apparatus.
Figure 34A:
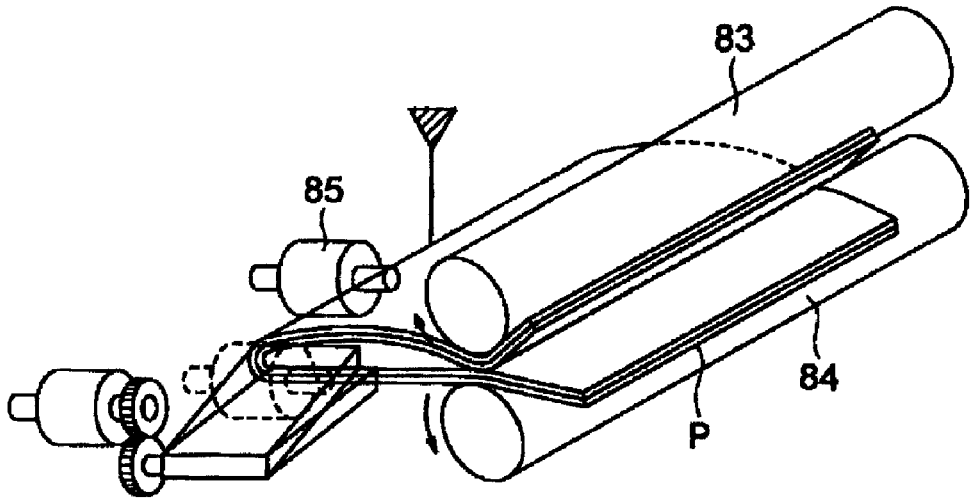
FIGS. 34A, 34B, and 34C are explanatory views of the operation of the related art sheet processing apparatus.
Figure 34B:
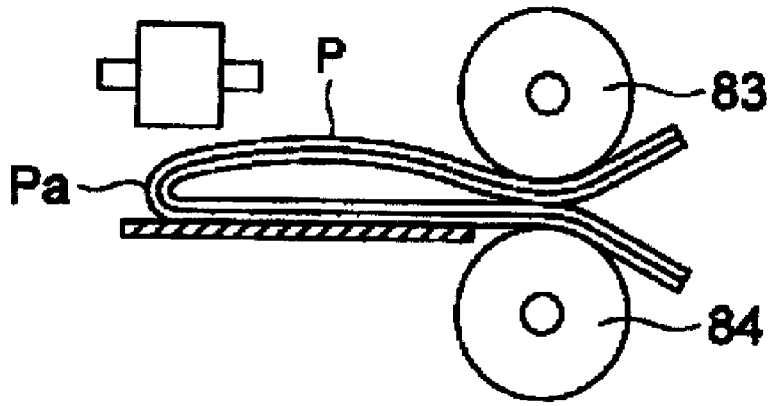
Figure 34C:
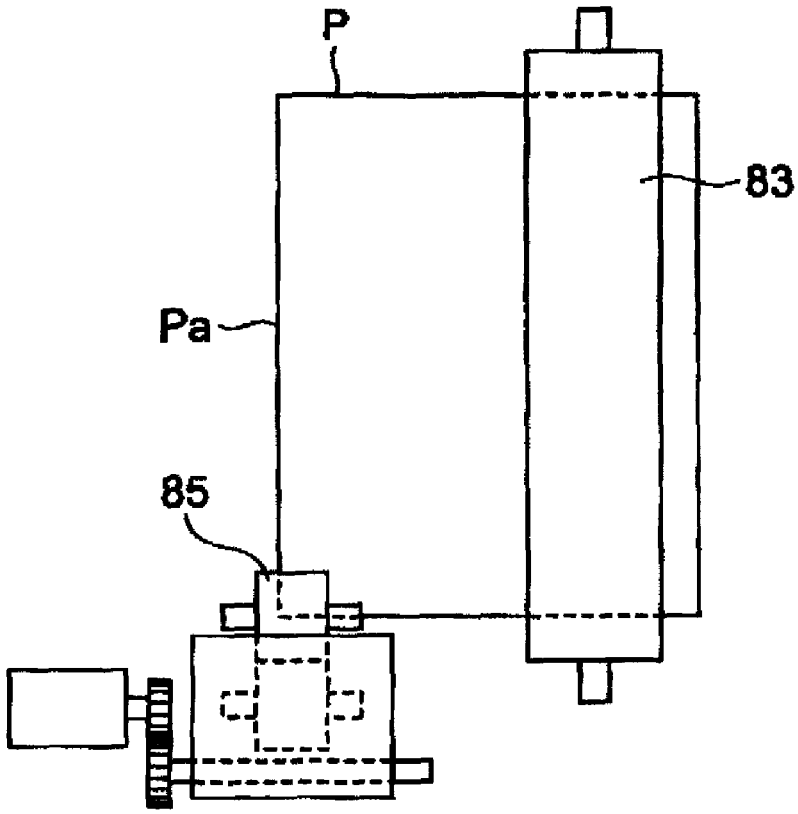

As shown in FIG. 31, after the first bundle of folded sheets P1 is discharged onto the stacking portion 893, an operation for receiving the next bundle of folded sheets P5 (an operation in which the first and second conveyor belts 894 and 895 perform reverse rotation) is performed. When swelling of the folded portion of the bundle of sheets subjected to the folding process by the operation is large, the stacking state of the bundles of folded sheets P1 and P2 is shifted and the bundle of folded sheets P2 slips into an opening of the bundle of folded sheets P1 by the discharge operation of the bundle of folded sheets P5. It is likely to occur in the operation in which the first and second conveyor belts 894 and 895 perform normal rotation.

In this embodiment, the pair of press rollers 861 are temporarily stopped for a predetermined time during movement along the fold of the folded portion for intermittent movement, thereby strengthening the fold. As shown in FIG. 26, without opening the openings, the bundles of folded sheets P are moved on the second stacking surface 892 in the stable state and are orderly stacked. Therefore the stitch bookbinding unit 800 reduces jamming of the bundle of folded sheets, stacking failure, and sheet folding. The miscounting of the number of the bundles of folded sheets by the user performing the operation is also reduced, thereby improving operability.

The bundle of folded sheets is guided in the upper direction by the second stacking surface 892 whose downstream end is inclined upward and can be easily taken out by the user. The third stacking surface 893 is accommodated under the second stacking surface 892 to provide the storing box 850 in the position in which the third stacking surface 893 has been located. Thereby the downstream end of the second stacking surface 892 is raised to increase the capacity of the storing box 850.

Second Embodiment

The operation pattern of the press rollers 861 controlled by the finisher controlling portion 515 will be described as a second embodiment.

Figure 27:
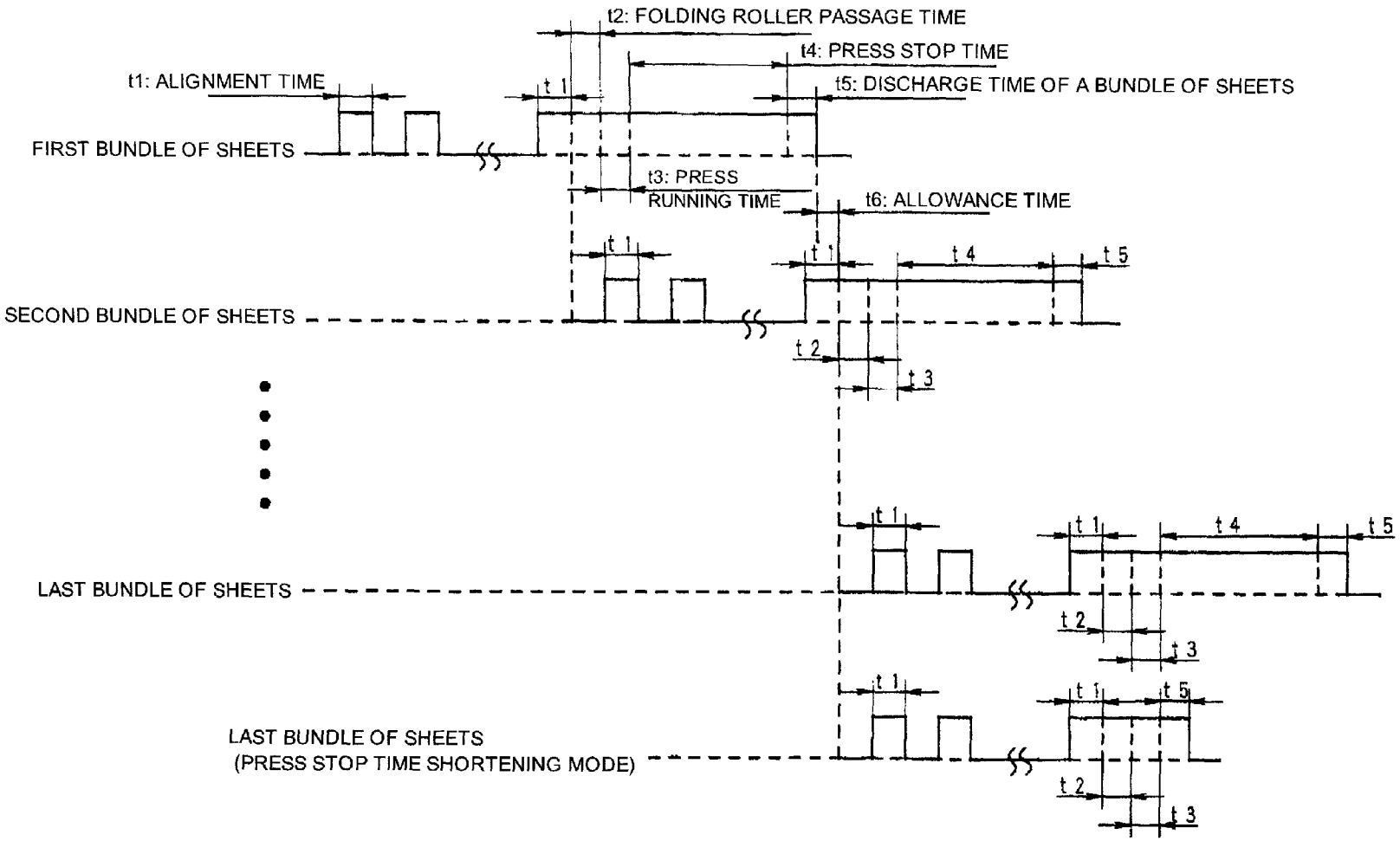
FIG. 27 is a timing chart in which a bundle of folded sheets is made.
Figure 28:
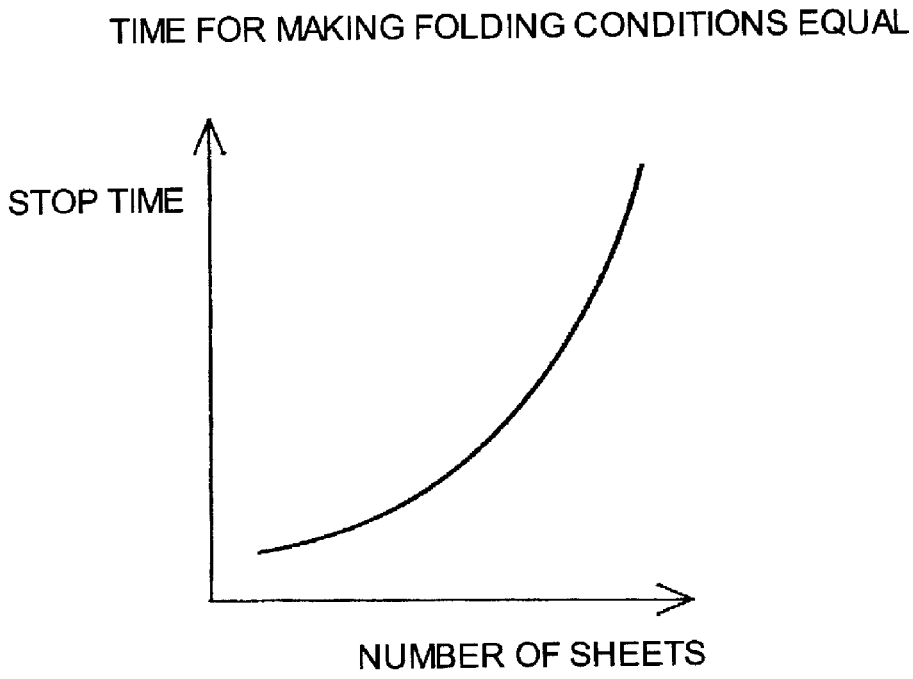
FIG. 28 is a diagram showing the relation between the number of sheets and necessary press stop time for making the folding conditions of bundles of folded sheets equal.

FIG. 27 is a timing chart of the sheet process performed by the stitch bookbinding unit 800. The reference symbol t1 denotes alignment time of each sheet in a bundle of sheets, the reference symbol t2 denotes press roller passage time, and the reference symbol t3 denotes running time of the press rollers when the press rollers run along the folded portion of the bundle of sheets without being stopped. The reference symbol t4 denotes total stop time of the press rollers when the press rollers are stopped during running along the folded portion of the bundle of sheets the reference symbol t5 denotes discharge time for discharging to the conveyor, and the reference symbol t6 denotes allowance time until the first sheet in the next bundle of folded sheets enters the storing guide 803. FIG. 28 is a graph showing the relation between time and the number of sheets in the bundle of sheets for making the folding heights of the bundles of sheets equal. The sheets are of the same kind in this embodiment. As understood from the graph, as the number of sheets in the bundle of sheets is increased, longer stop time is required. This is caused by stiffness increase as the thickness of the bundle of sheets is larger.

The timing of the sheet process is also different depending on sheet size. Specifically, as a sheet is smaller, it is harder to be folded. It is since the weight of the sheet is small, the distance from the folded portion to the front edge of the sheet is short, and the moment is small. When the bundle of folded sheets subjected to the folding process is, for example, laid as the state of the bundle of folded sheets P1 in FIG. 22, the force applied to the folded portion is weak so that it is easy to open.

As is apparent from FIGS. 27 and 28, it is found that as the number of sheets in the bundle of sheets is smaller, this affects the total productivity unless the total of the stop time t4 is reduced. It is also found that as the number of sheets in the bundle of sheets is smaller, the stop time is not necessary. The stop time t4 is changed according to the number of sheets to make the stop time t4 optimal so that the device can satisfy both productivity and folding properties. That is, when the number of sheets is small (the stiffness is small) and the size of sheet is large, the stop time t4 may be shortened. When the number of sheets is large (the stiffness is large) and the size of sheet is small, the stop time t4 may be increased.

Figure 29:
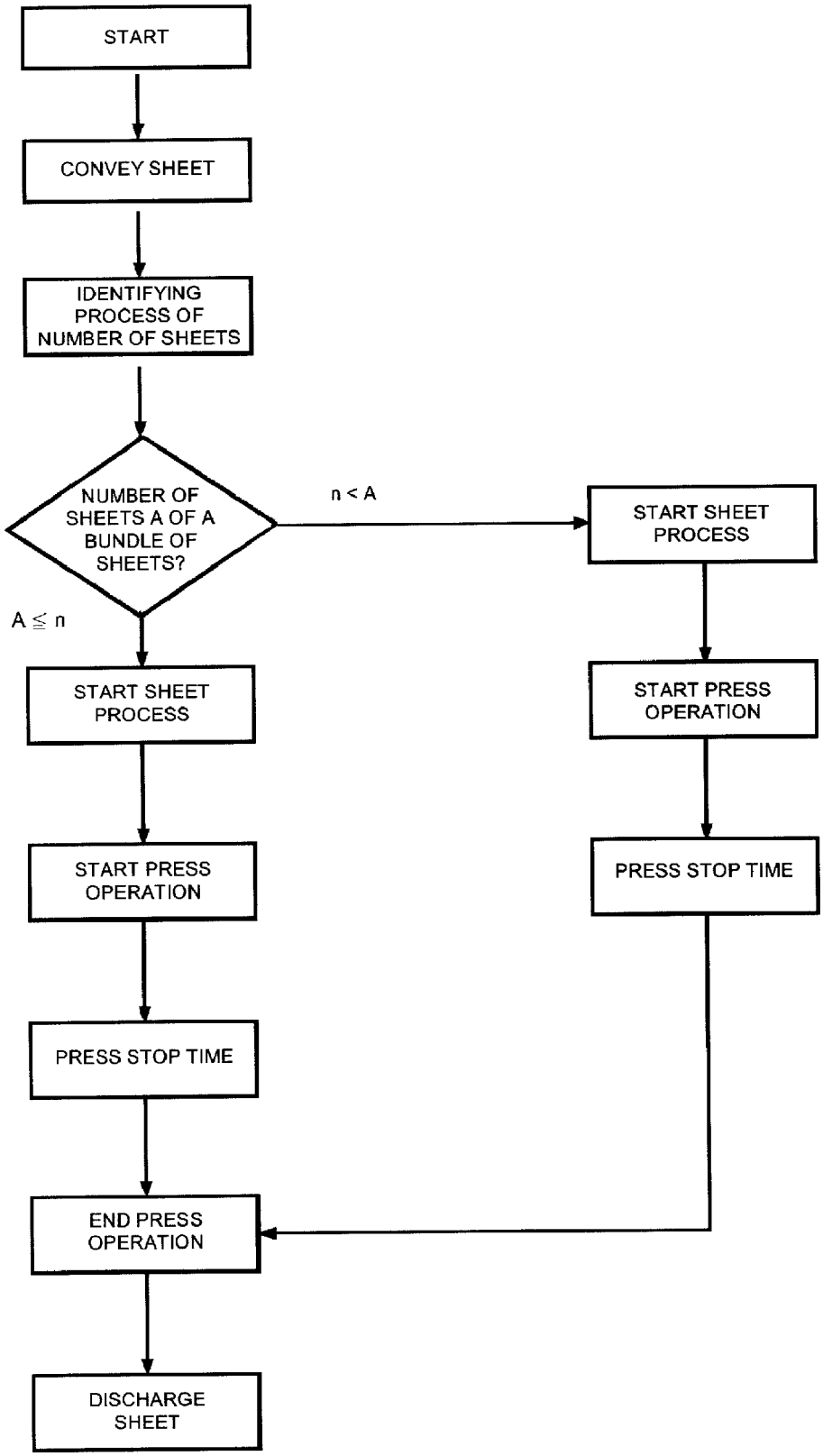
FIG. 29 is a flowchart showing the operation of this embodiment.
Figure 30:
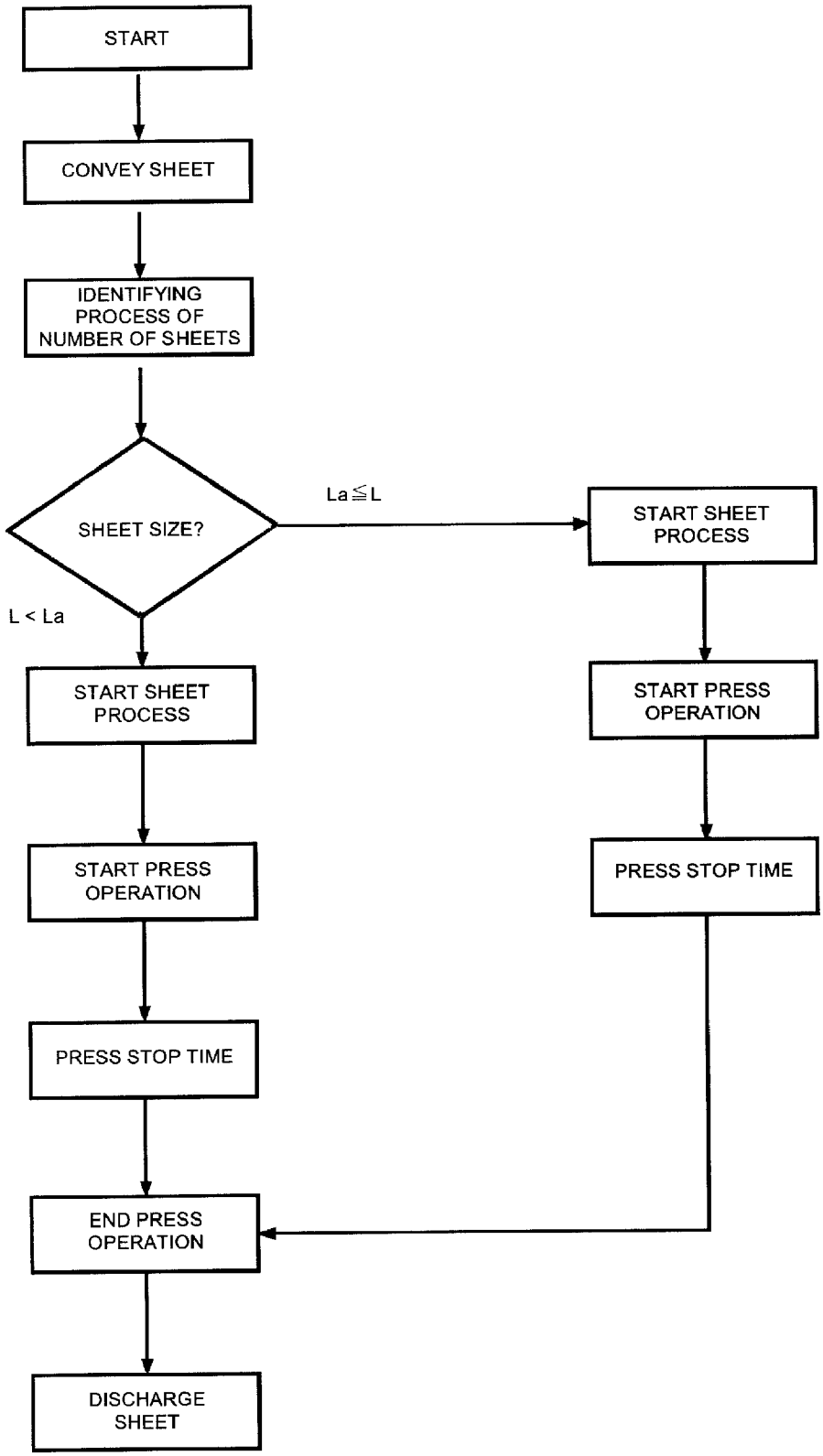
FIG. 30 is another flowchart showing the operation of this embodiment.

FIGS. 29 and 30 are flowcharts showing the operation at that time. When the number of sheets n in the bundle of sheets to be stitch bound is larger than a predetermined number of sheets A, the bundle of sheets is processed for stop time t. When the number of sheets n is smaller than the predetermined number of sheets A, the bundle of sheets is processed for stop time t' (<t) shorter than the stop time t (FIG. 29). When a size L of the sheet subjected to the stitch binding process is smaller than a predetermined size La, the sheet is processed for the stop time t. When the size L is larger than the predetermined size La, the sheet is processed for t' (<t) shorter than the stop time t (FIG. 30).

Instead of changing the stop time as described above, the number of stops may be changed. That is, the number of stops is increased to the bundle of folded sheets having a large stiffness, the bundle of folded small sheets, or a larger number of sheets forming the bundle of folded sheets, thereby making the fold more strongly. The stop time and the number of stops are changed according to at least one of the sheet conditions, enabling the satisfactory creasing process. In the bundle of folded small sheets, increase of the number of stops is however limited due to the length of the fold. Therefore it is preferable to combine change of the number of stops with change of the stop time. Such combination can respond to all bundles of folded sheets. As described above, at least one of change of the stop time and change of the number of stops is executed, making it possible to perform the satisfactory creasing process.

In the job to form a plurality of bundles of folded sheets, FIG. 27 shows an example in which when a plurality of bundles of folded sheets are successively subjected to the creasing process, the last bundle of sheets is not subjected to the creasing process. According to the example, the sheet processing time of the last bundle of sheets is reduced by t4. The bookbinding time of the entire bookbinding job (total time) can be shortened by t4 thereby improving the productivity of the device. Although the folding properties of the last bundle of sheets are weak, the sheet bundle retainer member 11 prevents it from being opened. Due to the last bundle of sheets, the next bundle of sheets cannot slip thereinto. Therefore the stacking properties on the conveyer cannot be disturbed.

In the above embodiments, the creasing process of the bundle of a plurality of sheets is described. Needless to say, the present invention is also effective for the creasing process of a folded sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2007-024371, filed Feb. 2, 2007 and No. 2008-008379, filed on Jan. 17, 2008, which are hereby incorporated by reference herein in their entirety.

What is claimed is:

1. A sheet processing apparatus having:

a folding unit which performs a folding process to a sheet bundle made up of a plurality of sheets;

a creasing unit which presses a fold of the sheet folded by the folding unit;

a moving unit which brings relative movement between the creasing unit and the folded sheet bundle in a direction parallel to the fold; and a controlling unit which controls the moving unit, wherein the controlling unit controls the moving unit so that the relative movement between the creasing unit and the folded sheet bundle makes a stop for a stop time at least once while the creasing unit presses the fold.

2. The sheet processing apparatus according to claim 1, wherein the controlling unit changes at least one of the stop time and the number of stops in the relative movement to perform stop control in the relative movement so that when the size of the sheet is smaller than a predetermined size, at least one of the stop time and the number of stops is increases.

3. The sheet processing apparatus according to claim 1, wherein the controlling unit changes at least one of the stop time and the number of stops in the relative movement so that when the number of sheets is larger than a predetermined number, at least one of the stop time and the number of stops is increased.

4. The sheet processing apparatus according to claim 1, wherein the controlling unit changes the stop time according to the stop position of the creasing unit on the folded sheet bundle.

5. The sheet processing apparatus according to claim 1, wherein the creasing unit comprises a pair of press rollers nipping the fold of the folded sheet bundle and relatively moving along the fold.

6. The sheet processing apparatus according to claim 1, wherein the folding unit has a pair of folding rollers formed with concave and convex portions in the outer circumference in the longitudinal direction and forms a nip by matching the concave and convex portions of one of the folding rollers with those of the other, and wherein when the creasing unit moves on the folded sheet bundle in the direction parallel to the fold, the stop position of the creasing unit on the folded sheet bundle is set to the position corresponding to the concave portion of the folding roller.

7. The sheet processing apparatus according to claim 6, wherein the folding unit has a push-out member pushing the sheet bundle into the nip of the folding rollers, and wherein the push-out member has convex portions which can enter spaces formed by matching the concave portions of one of the folding rollers with those of the other.

8. An image forming apparatus comprising:

an image forming portion which forms an image on a sheet; and a folding unit which performs a folding process to a sheet bundle made up of a plurality of sheets;

a creasing unit which presses a fold of the sheet bundle folded by the folding unit;

a moving unit which brings relative movement between the creasing unit and the folded sheet bundle relatively in a direction parallel to the fold; and a controlling unit which controls the moving unit, wherein the controlling unit controls the moving unit so that the relative movement between the creasing unit and the folded sheet bundle makes a stop for a stop time at least once while the creasing unit presses the fold.

9. The image forming apparatus according to claim 8, wherein the controlling unit changes at least one of the stop time and the number of stops in the relative movement of the creasing unit and the folded sheet to perform stop control in the relative movement so that when the size of the sheet is smaller than a predetermined size, at least one of the stop time and the number of stops is increased.

10. The image forming apparatus according to claim 8, wherein the controlling unit changes at least one of the stop time and the number of stops in the relative movement of the creasing unit and the folded sheet to perform stop control in the relative movement so that when the number of sheets is larger than a predetermined number, at least one of the stop time and the number of stops is increased.

11. An image forming apparatus comprising:

an image forming portion which forms an image on a sheet;

a sheet processing apparatus which processes the sheet formed with the image; and a controlling unit which controls the sheet processing apparatus, the sheet processing apparatus having:

a folding unit which performs a folding process to a sheet or the bundle of sheets a creasing unit which presses a fold of the sheets folded by the folding unit; and a moving unit which moves the creasing unit and the folded sheets relatively in a direction parallel to the fold, wherein the controlling unit controls the moving unit so that the relative movement between the creasing unit and the folded sheet is intermittently stopped while the fold is being pressed by said fold strengthening mechanism.

* * * * *